US009635916B2

(12) United States Patent
Bezich et al.

(10) Patent No.: US 9,635,916 B2
(45) **Date of Patent: *May 2, 2017**

(54) HYBRID MODULAR FURNITURE AND STORAGE CONTAINER UNIT

(71) Applicants: Lara Bezich, Laconia, NH (US); Peter Castellucci, Somerville, MA (US)

(72) Inventors: Lara Bezich, Laconia, NH (US); Peter Castellucci, Somerville, MA (US)

(73) Assignee: MUVO, LLC, Syracuse, NY (US)

( * ) Notice: Subject to any disclaimer, the term of this patent is extended or adjusted under 35 U.S.C. 154(b) by 305 days.

This patent is subject to a terminal disclaimer.

(21) Appl. No.: 14/182,926

(22) Filed: Feb. 18, 2014

(65) Prior Publication Data

US 2014/0231285 A1 Aug. 21, 2014

Related U.S. Application Data

(63) Continuation of application No. 13/244,252, filed on Sep. 23, 2011, now Pat. No. 8,651,593.

(Continued)

(51) Int. Cl.

*A47B 77/00* (2006.01)
*A45C 11/00* (2006.01)

(Continued)

(52) U.S. Cl.

CPC ..... *A45C 11/00* (2013.01); *A47B 87/0276* (2013.01); *A47B 87/0292* (2013.01); *B65D 1/22* (2013.01); *B65D 5/445* (2013.01); *B65D 5/4608* (2013.01); *B65D 5/566* (2013.01); *B65D 5/68* (2013.01); *B65D 21/00* (2013.01); *B65D 21/0202* (2013.01); *B65D 25/2897* (2013.01); *B65D 43/022* (2013.01); *B65D 43/0222* (2013.01); *B65D 43/22* (2013.01); *B65D 81/361* (2013.01); *A47B 2220/0083* (2013.01); *B65D 2543/00194* (2013.01); *B65D 2543/00296* (2013.01); *B65D 2543/00509* (2013.01);

(Continued)

(58) Field of Classification Search

CPC ..... B65D 5/4608; B65D 5/445; B65D 1/22; B65D 21/00; A47B 87/0292; A47B 87/0276; A45C 11/00

USPC ..... 312/107, 108, 257.1, 258–262; 229/103.11, 122.32, 122.34, 185.1

See application file for complete search history.

(56) References Cited

U.S. PATENT DOCUMENTS 1,970,582 A 8/1934 Snyder et al.
2,293,361 A 8/1942 Roberts (Continued)

*Primary Examiner* — Daniel J Troy
*Assistant Examiner* — Timothy M Ayres
(74) *Attorney, Agent, or Firm* — Berenato & White, LLC

(57) ABSTRACT

In accordance with an embodiment, a hybrid modular furniture and container unit includes a base shell, a base core layer, and a set of base inner panels. The base shell has a shell bottom, a first shell wall, a second shell wall, a third shell wall, a fourth shell wall, and upper flaps associated with each of the respective walls. The base core layer has a core bottom, a first core wall, a second core wall, a third core wall, and a fourth core wall. The core layer is disposed within the base shell. The base inner panels include a first inner panel wall, a second inner panel wall, a third inner panel wall, and a fourth inner panel wall. The inner panel walls disposed within the shell and each upper flap is folded over a respective core wall and inner panel wall.

19 Claims, 23 Drawing Sheets

Related U.S. Application Data

(60) Provisional application No. 61/385,874, filed on Sep. 23, 2010.

(51) Int. Cl.

| | |
|---|---|
| ***A47B 87/02*** | (2006.01) |
| ***B65D 1/22*** | (2006.01) |
| ***B65D 5/44*** | (2006.01) |
| ***B65D 5/468*** | (2006.01) |
| ***B65D 5/56*** | (2006.01) |
| ***B65D 5/68*** | (2006.01) |
| ***B65D 21/02*** | (2006.01) |
| ***B65D 25/28*** | (2006.01) |
| ***B65D 43/02*** | (2006.01) |
| ***B65D 43/22*** | (2006.01) |
| ***B65D 81/36*** | (2006.01) |
| ***B65D 21/00*** | (2006.01) |

(52) U.S. Cl.

CPC ..... *B65D 2543/00527* (2013.01); *B65D 2543/00537* (2013.01); *B65D 2543/00546* (2013.01); *B65D 2543/00842* (2013.01); *Y10T 29/49716* (2015.01)

(56) References Cited

U.S. PATENT DOCUMENTS

| | | | | |
|---|---|---|---|---|
| 3,503,550 | A | 3/1970 | Main et al. | |
| 3,856,147 | A | 12/1974 | Piretti | |
| 4,376,558 | A | 3/1983 | Bandar | |
| 5,215,248 | A | 6/1993 | Moser | |
| 5,417,342 | A | 5/1995 | Hutchison | |
| 5,466,058 | A | 11/1995 | Chan | |
| 5,507,385 | A | 4/1996 | Koloski | |
| 5,595,429 | A | 1/1997 | Kennedy | |
| 5,683,781 | A | 11/1997 | Komarek | |
| 5,888,114 | A | 3/1999 | Solcum | |
| 6,009,816 | A | 1/2000 | Wendel | |
| 6,267,462 | B1 | 7/2001 | Krause | |
| 6,325,281 | B1 | 12/2001 | Grogan | |
| 8,651,593 | B2 * | 2/2014 | Bezich ..... | B65D 43/22 312/259 |
| 2002/0070641 | A1 | 6/2002 | Ragan | |
| 2004/0079794 | A1 | 4/2004 | Mayer | |
| 2006/0250052 | A1 | 11/2006 | Davis | |
| 2010/0314437 | A1 | 12/2010 | Dowd | |
| 2011/0147391 | A1 | 6/2011 | Corder et al. | |

* cited by examiner

SECTION A-A

SECTION E-E

HYBRID MODULAR FURNITURE AND STORAGE CONTAINER UNIT

CLAIM TO PRIORITY

This application is based on provisional application Ser. No. 61/385,874, filed Sep. 23, 2010, the disclosure of which is incorporated herein by reference and to which priority is claimed.

FIELD OF THE INVENTION

The present invention relates to portable storage containers that can be converted to furniture.

BACKGROUND

Traditional furniture may provide surfaces and accessible chambers for placing and storing objects. Furniture requires fewer steps to access stored items than other storage methods. For example, stackable boxes require a process of unstacking and uncovering to access their storage chambers. Traditionally, the elements that compose a furniture assembly are static. That is, a person cannot reconfigure the arrangement of drawers, shelves, and cabinet doors in a built piece of furniture.

Stackable storage containers are used for a variety of storage needs, such as the storage of household articles. They are typically rectangular shaped, having either an open top or lidded top. Storage containers are typically intended to stack base to lid, primarily for use in long-term storage situations. When these containers are stacked, they do not provide ease of entry into the container to retrieve or to insert articles.

Modular furnishings utilize various furniture components that may be placed together to form different storage and workspace areas. Modular furniture is typically made of composite materials that may be fragile and do not withstand impacts and abrasion well. Often furnishings of this type are made of chip board or particle board, and joined inexpensively with glues and screws.

Some modular furnishing systems may be disassembled to flat panels for moving. Moving is generally a cumbersome, disorganized, and inefficient process. One must purchase or locate moving containers. Then objects must be emptied from furniture and placed into the containers. The containers must be moved separately but along with the empty and sometimes disassembled furniture. Upon reaching the final destination, the furniture must be unpacked and reassembled and objects must be unpacked and placed back into the furniture. Finally, the now empty moving containers need to be trashed, recycled, or stored. This adds expense and time to the task of moving, something a significant portion of the U.S. population does on a yearly basis.

SUMMARY

In accordance with an embodiment, a hybrid modular furniture and container unit includes a base shell, a base core layer, and a set of base inner panels. The base shell has a shell bottom, a first shell wall, a second shell wall, a third shell wall, a fourth shell wall, and upper flaps associated with each of the respective walls. The base core layer has a core bottom, a first core wall, a second core wall, a third core wall, and a fourth core wall. The core layer is disposed within the base shell. The base inner panels include a first inner panel wall, a second inner panel wall, a third inner panel wall, and a fourth inner panel wall. The inner panel walls disposed within the shell and each upper flap is folded over a respective core wall and inner panel wall.

In accordance with another embodiment, a hybrid storage container and modular furniture apparatus includes a base, a lid, and at least one internal component. The base includes a bottom, a first wall, a second wall, a third wall, and a fourth wall connected to define an internal cavity and an open top. A first channel is formed in the first wall on a surface of the first wall facing the internal cavity. A second channel corresponding to the first channel is formed in a wall oppositely disposed the first wall, the second channel is formed on a surface facing the internal cavity. At least one internal component slidably receivable in the internal cavity via the first and second channel. A lid is connectable to the open top of the base.

BRIEF DESCRIPTION OF THE DRAWINGS

FIG. 11AA is a plan, sectional view of the exemplary lid and handle of FIG. 11A.

DETAILED DESCRIPTION OF EXEMPLARY EMBODIMENT(S) AND EXEMPLARY METHOD(S)

Figure 1:
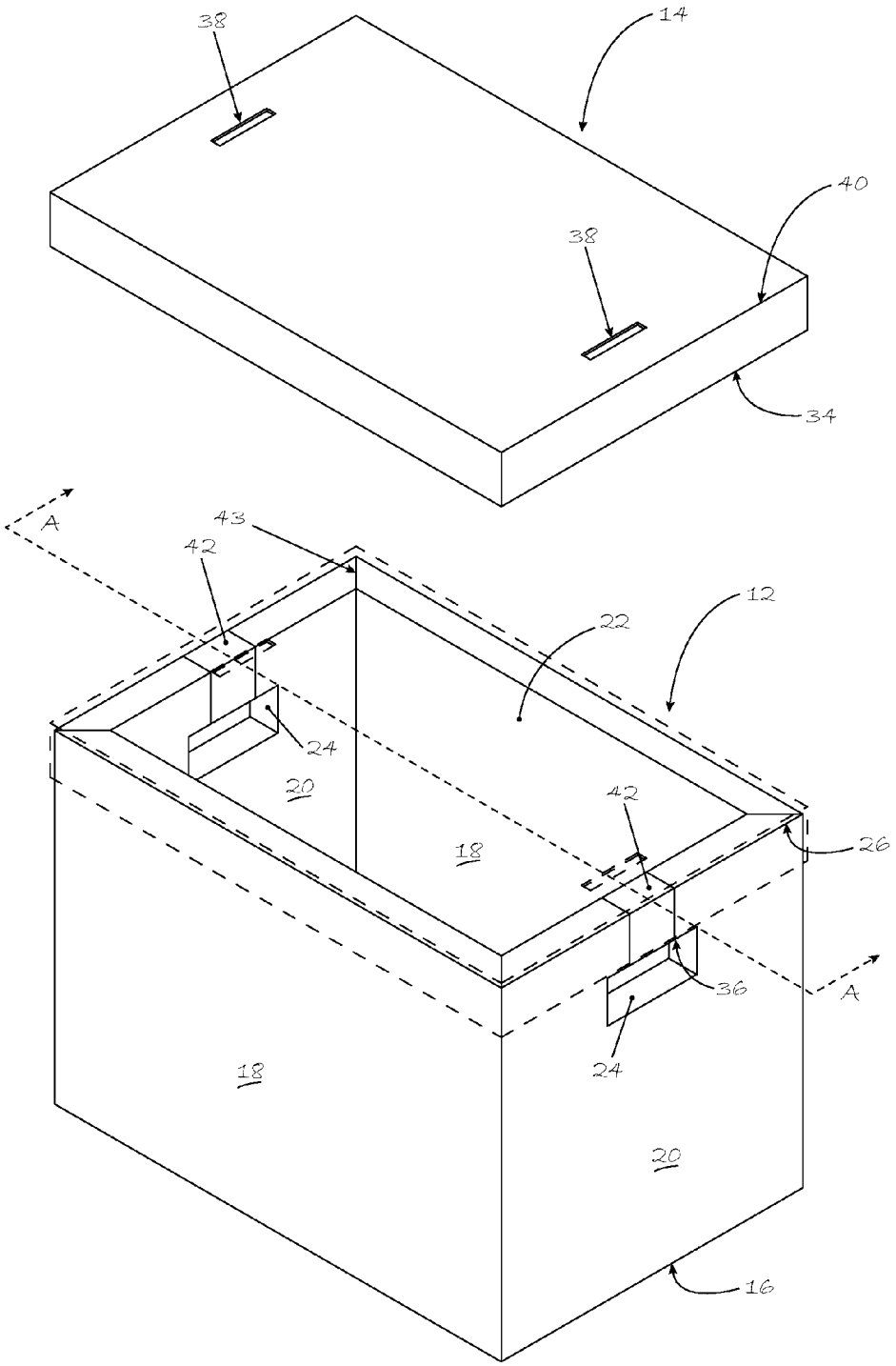
FIG. 1 is a perspective view of an exemplary hybrid modular furniture and storage unit.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

FIG. 1 depicts an exemplary embodiment of a hybrid modular furniture and storage unit 10. The hybrid unit 10 has a base 12 and a lid 14. Though the base 12 and lid 14 are shown as rectangular, it should be understood that the size and shape of various components may vary. The base 12 has a bottom 16 and two side-walls 18 and two end-walls 20 extending from the bottom 16. The side-walls 18 and end-walls 20 may extend upward at approximately a 90 degree angle. The bottom 16, side-walls 18 and end-walls 18 define a chamber 22. The end-walls 20 may each contain a handle 24. In an exemplary embodiment, the handle 24 is approximately located in the upper half and central area of the end-walls 20. In various exemplary embodiments, the thickness of the walls 16, 18, 20 is between 2 to 5 cm, and the hybrid unit 10 has a length of approximately 30-50 cm and a width of approximately 30-75 cm.

The lid 14 includes a top wall 28 and two lid side-walls 30 and two lid end-walls 32 extending from the top wall 28. The side-walls 30 and end-walls 32 may extend downward at approximately a 90 degree angle. The lid 14 may be made from corrugated cardboard, chipboard, polypropylene, or other materials. In an exemplary embodiment, when the lid 14 is placed on the base unit 12 the lower edge 34 of the lid end-walls 32 extends approximately to the upper edge 36 of the handles 24.

The lid 14 helps protect the contents in the chamber 22 from weather and other damaging external forces. Additionally, the lid 14 helps prevent items from falling out of the chamber 22. By providing a lid 14 the hybrid unit 10 may be quickly and easily converted from modular furniture to a container that may be properly packed and shipped.

The top wall 28 of the lid 14 may contain two openings 38 that are approximately parallel with each lid end-wall 32. In an exemplary embodiment the openings 38 are positioned so that when the lid 14 is placed on top of the base 12, the openings 38 are just inside base end-walls 20. For example the openings may be located approximately 2 cm to 5 cm inwards from an edge 40 of the lid end-wall 32 and each opening 38 extends approximately 2 cm to 5 cm in length. The openings 38 may be slots, holes, or other suitable sized and shaped openings.

In an exemplary embodiment, a strap 42 loops through the handle 24 and through the opening 38 when the lid 14 is connected to the base 12. The strap 42 secures the lid 14 to the base 12 for when the hybrid unit 10 is in transport or storage. The straps 42 may be composed of any material including woven, fibrous, plastic, etc. Once the lid 14 is placed on the base unit 12, the loose ends of the straps 42 may be tied, taped, stapled, or otherwise secured together. The straps 42 may also include a fastener, such as a buckle, button, snap, or any known connector. In various exemplary embodiments, the straps 42 are connected to the base 12 or the lid 14 so that they remain with the hybrid unit 10 when not in use. For example, a strap 42 may be adhesively secured to the handle 24 with enough free material to thread through the opening 38. The strap 42 may also be connected through stitching, mechanical fasteners, or other methods.

Figure 2:
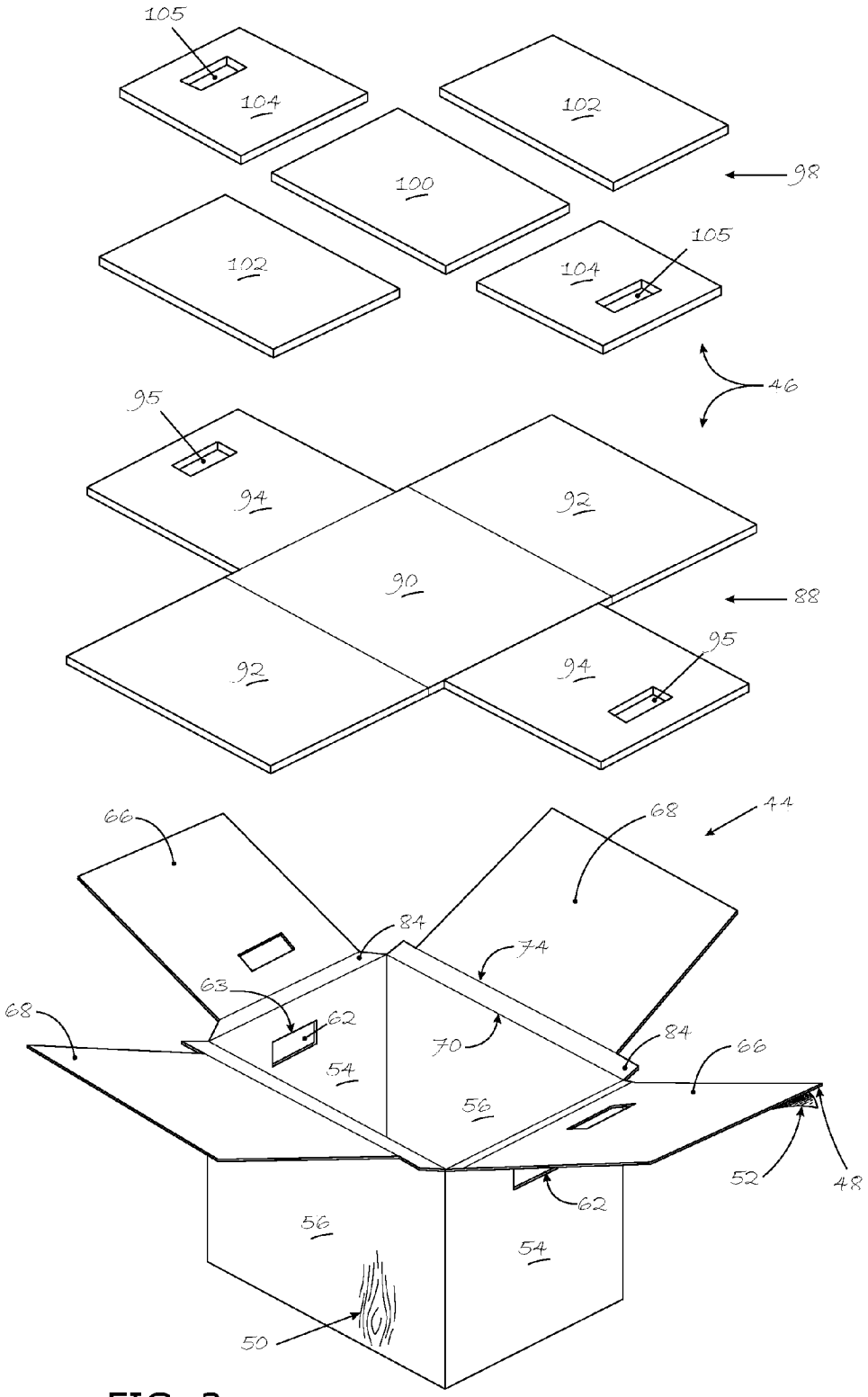
FIG. 2 is a perspective, assembly view of the exemplary base of the hybrid unit of FIG. 1.

FIG. 2 depicts an exemplary embodiment of the base 12. The base 12 may be composed of a shell 44 and interior components 46. The shell 44 may be composed of a cellulosic material such as chipboard, corrugated cardboard, polypropylene sheet, though any material, such as polymers or composite materials may be used. The interior components 46 may be a single component or it may be multiple layers. In an exemplary embodiment, the interior components 46 are made from a rigid, strong, and lightweight material such as paper honeycomb or hexacomb. The interior components 46 may also be made from plastic honeycomb, structural foam, or other natural and/or synthetic materials.

The shell 44 forms the outer layer of the base 12 and has an outer surface 48. In an exemplary embodiment the outer surface 48 may be printed with a color, image, or a pattern 50, such as a wood grain pattern shown in FIG. 3. The pattern 50 or other images may be printed directly onto the shell 44. The pattern 50 may then be covered with a protective or water resistant coating or varnish. The pattern 50 may also be printed onto a sheet 52 and attached to the shell 44. The sheet 52 may be a laminate, such as a paper laminate, foil, or veneer. The sheet 52 may be treated with latex, silicon, polyester, or other water-resistant coating or varnish. In an exemplary embodiment the sheet 52 is a paper foil laminated to the outer surface 48.

Figure 3:
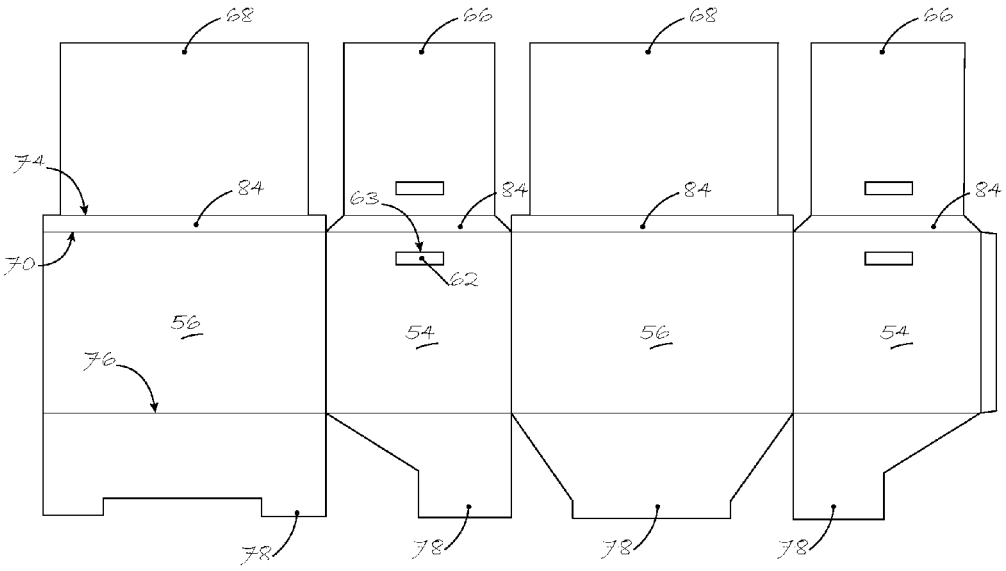
FIG. 3 is a plan view of the exemplary unfolded shell of the base of FIG. 2.

As best shown in FIGS. 2 and 3, the shell 44 has two shell end-walls 54 and two shell side-walls 56. The end walls 54 and side walls 56 are foldably connected to each other at corner folds 58. A tab 60 extends from one of the shell side walls 56. The tab is foldable along the edge of the shell side-wall 56 and adheres to the inside of the adjoining shell end-wall 54. The tab 60 may also extend from the shell end-wall 54 and adhere to the shell side-wall 56. Each shell end-wall 54 may include a handle flap 62. In various exemplary embodiments, the handle flap 62 is foldably connected along its upper edge 63 and can be folded into and/or out of the shell 44 to reveal an opening. The handle flap 62 also may be selectively removable from the shell 44.

In an exemplary embodiment, the shell 44 includes end-wall upper flaps 66 and side-wall upper flaps 68. Both pairs of upper flaps 66, 68 may be hingedly connected to the shell end-walls 54 and shell side-walls 56 at a primary fold 70. The primary fold 70 may extend around the shell side and end-walls 54, 56 or it may be broken up at the corner folds 58.

In various exemplary embodiments, the upper flaps 66, 68 may be folded into the chamber 22 and are long enough to cover the interior components 46. The shell upper flaps 66, 68 may contain a secondary fold 74 that helps the upper flaps 66, 68 envelop the interior layers 46. The secondary fold 74 may run parallel to the primary fold 70, and may be spaced from the primary fold 70. The distance between the primary fold 70 and the secondary fold 74 depends on the size and number of interior components 46. For example, the secondary fold 74 is spaced approximately 2 to 5 cm above the primary fold 70.

As best shown in FIG. 3, a bottom fold 76 extends along the bottom of the shell side-walls 56 and shell end-walls 54. Bottom flaps 78 are foldably connected to the shell side-walls 56 and shell end-walls 54 along the bottom fold 76. The bottom flaps 78 may be folded at an approximately 90 degree angle and connected together in a one-two-three-four flap style known to those of ordinary skill in the art. This connection eliminates the need for adhesive to hold the bottom flaps 78 together. Other styles of interlocking or non-interlocking flaps also may be used, including attachment through adhesives or mechanical fasteners.

In various exemplary embodiments, the end-wall upper flaps 66 and side-wall upper flaps 68 are narrower than the end-walls 54 and side-walls 56 respectively. The reduced width may enable the upper flaps 66, 68 to more easily fold into the chamber 22. The shell end-walls 54 and side-walls 56 may therefore be connected to the upper flaps 66, 68 through transition portions 84. In an exemplary embodiment, the transition portions 84 extend between the primary fold 70 and the secondary fold 74. The transition portions 84 may reduce in width along an angle. For example, the transition portion 84 connected to the end wall upper flaps 66 may have an angle of approximately 45 degrees as best shown in FIG. 1 and FIG. 3. The transition portions 84 may overlap to help prevent gaps from occurring between the upper flaps 66, 68, which would expose the interior components 46. To better facilitate overlapping, an angle of approximately 90 degrees may be provided in the side-wall upper flaps 68. In various exemplary embodiments, the transition portion 84 angles may be switched or may otherwise vary from 0-90 degrees.

As best shown in FIG. 2, the interior components 46 of the base 12 may include a core layer 88. In various exemplary embodiments, the core layer 88 is a single piece of cross-shaped material, and may be made of paper honeycomb, hexacomb, or triple-walled corrugated cardboard though other cellulosic, polymeric, or composite materials may be used. The core layer 88 has a core bottom 90 from which the "arms" of the cross shape extend, forming two core side-walls 92 and two core end-walls 94. A core hinge 96 may be provided where the core bottom 90 meets the core end and side walls 92, 94. The core hinge 96 may be a fold or other type of living hinge formed into the core layer 88, though the side-walls 92 and end-walls 94 may be capable of folding without any additional structural changes. In an exemplary embodiment, the core hinge 96 is formed from crushing to facilitate easier folding. For example, blunt metal bars attached to a die-cutting tool may be pressed into the core layer 88 to deform the material and form the core hinge 96. In an exemplary embodiment, the core end-walls 94 contain core handles 95 that approximately align with the handle flaps 62 in the shell end-walls 54. The size of the core handles 95 may also approximately correspond in size with the handle flaps 62 in the shell end-walls 54.

The interior components 46 of the base 12 may also include inner panels 98. The inner panels 98 may be made of paper honeycomb, though other cellulosic, polymeric, or composite materials may be used. In an exemplary embodiment, there are five inner panels 98; an inner panel bottom 100, a pair of inner panel side-walls 102, and a pair of inner panel end-walls 104. The inner panels 100, 102, 104 may be slightly smaller than the respective core bottom 90 and core side and end-walls 92, 94. The inner panels 98 also may contain inner handles 105 that approximately align with the handle flaps 62 in the shell end-walls 54. The size of the inner handles 105 may also approximately correspond in size with the handle flaps 62 in the shell end-walls 54. The core handles 95 and inner handles 105 may be cut out with a die.

Figure 4A:
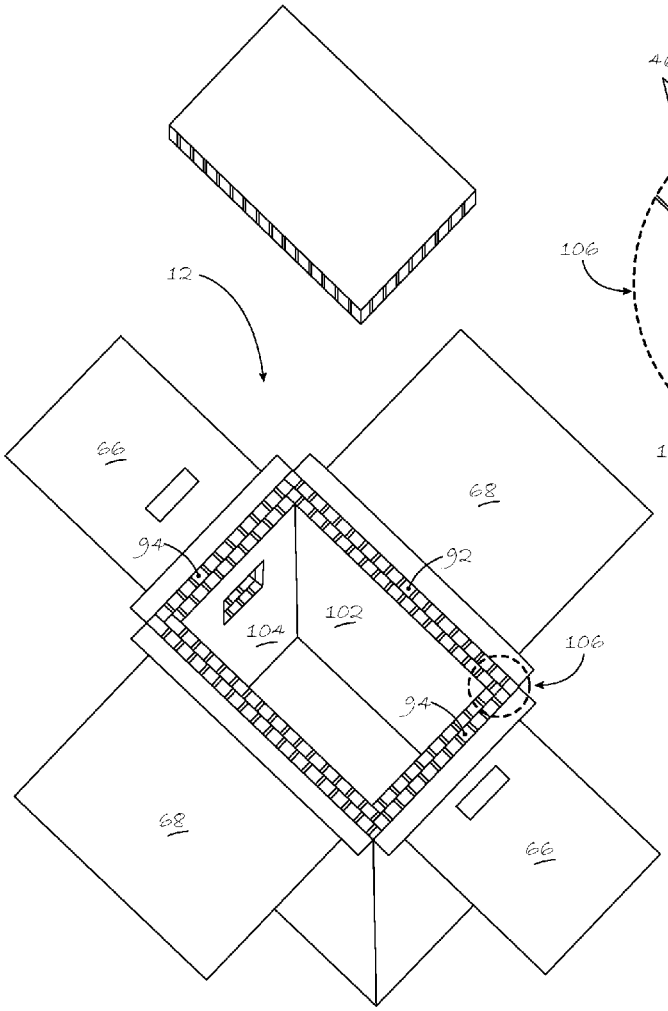
FIG. 4A is a perspective, partial assembly view of the exemplary base of FIGS. 1 and 2.
Figure 4B:
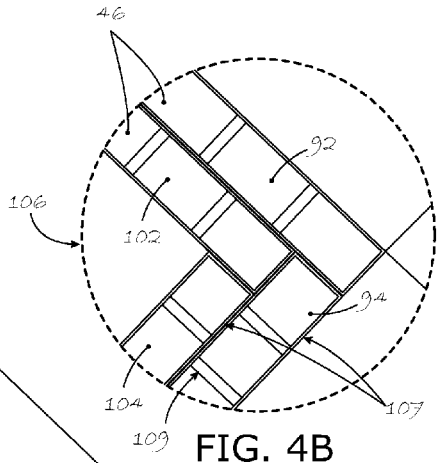
FIG. 4B is a perspective, exploded view of an exemplary corner joint of FIG. 4A.

FIG. 4A depicts an exemplary embodiment of a partially assembled base unit 12 in which the upper flaps 66, 68 are left open to show the arrangement of the interior components 46. The interior components 46 may rest within one another in a close relationship, though various spaces and gaps may be present. As best shown in FIG. 4B, the interior components 46 may touch together in a double butt joint configuration 106. For example, the core side-wall 92 may extend beyond the inner panel side-wall 102 and the core end-wall 94 so that the outer edge of the core side-wall 92 is adjacent the shell 44. The core end-walls 94 are therefore adjacent the inner major planar surface of the core side-walls 92 and inner panel end-walls 104 are adjacent the inner major planar surface of the side-wall inner panels 102.

The double butt joint 106 is strong when pressured from an external force coming from either direction. In various exemplary embodiments, the interior components 46 contain paper honeycomb. Paper honeycomb may be formed from honeycomb cells 109 sandwiched between paper liners 107 made from heavyweight paper, and therefore maintains a strong edge crush-resistance. Additional edge crush-resistance may be achieved by using a honeycomb panel that substitutes corrugated cardboard for at least one of the paper liners 107, with the flute direction running perpendicular to the double butt joint 106. An example of a similar material is manufactured by Cascades Corporation of Toronto, Calif.

In various exemplary embodiments, the combination of the single-piece core layer 88 and the double butt joint 106 provides exceptional strength relative to typical storage containers and modular furniture. The hybrid units 10 may be used to carry and store heavy objects, such as books. The hybrid units 10 also may be oriented either vertically or horizontally, with the chamber 22 facing any direction and stacked upon each other in multiples. In this way the base 12 may transform from functioning as a storage container or moving box to functioning as furniture. Whereas typical modular furniture has relatively weak joinery and has one side that is stronger than the other.

Figure 5A:
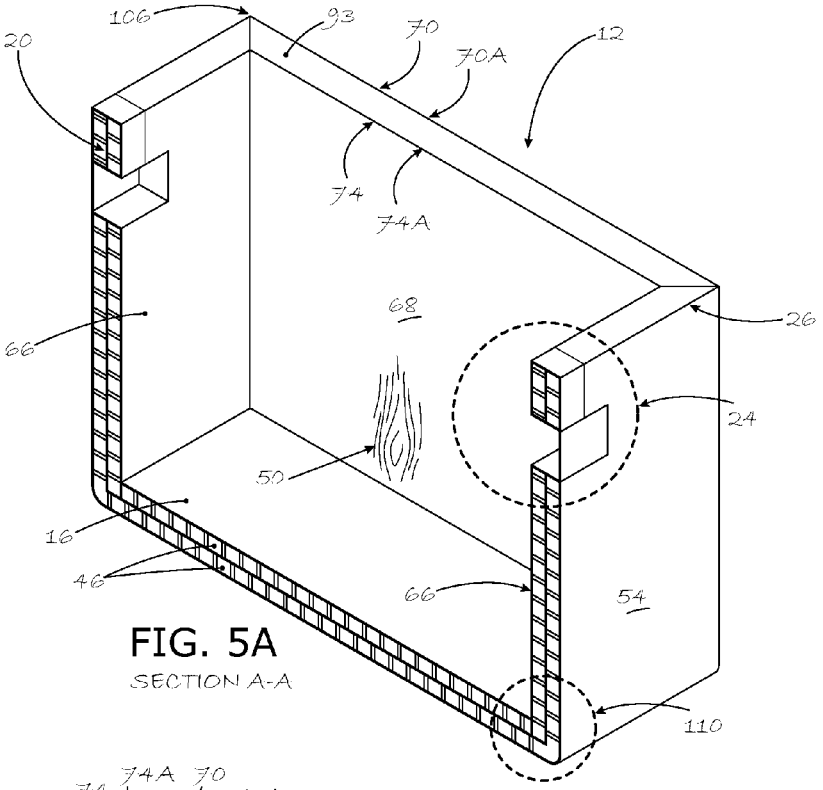
FIG. 5A is a perspective, sectional view of the exemplary base of FIGS. 1-4A.

FIG. 5A depicts an exemplary embodiment of a fully assembled base 12. The primary folds 70 of the shell 44 may fold at the core side-walls 92 and end-walls 94 to form an outer top edge 70A. The secondary fold 74 may fold at the inner panel side and end-walls 102, 104 to form an inner top edge 74A. The transition portions 84 lay over the top edge of the core 88 and the inner panels 98. The transition portions 84 may slightly overlap at the double butt joint 106. For example, the end-wall upper flaps 66 containing the 45 degree transition portions 84 may overlap the side wall upper flaps 68 containing the 90 degree transition portions 84. This prevents gapping between the adjoining upper flaps 66, 68, so as not to show the interior layers 46. The shell upper flaps 66, 68 completely envelope the interior panels 46 so that the distal edge 108 of the shell upper flaps 66, 68 touch the major planar surface of the core bottom 90.

In various exemplary embodiments, the shell 44 and the interior components 46 may be assembled without adhesives or mechanical fasteners. For example, the interior layers 46 may be held together by the assembled shell 44. If the shell 44 is ever damaged, it can be replaced with a new shell 44 and the interior components 46 may be reused. Additionally, the shell 44 may be swapped out with shells 44 having different patterns 50 as desired. In this way, a person can easily and cheaply change the look of their furniture.

The shell and internal components 46 also provide a hybrid unit 10 that has a high strength to weight ratio. The hybrid unit 10 provides greater strength and ease of transport than typical modular furniture. When a person carries a container having no handles, they must grip the bottom corners to support the weight. Most of the weight is on the bottom wall of the container. The strength of the container is related primarily to how effectively that bottom wall disperses the weight to the bottom corners. When a person carries a container having handles, the strength of the container is not only dependent on the rigidity and strength of the bottom wall, because the person's hands are no longer supporting the weight from below at the bottom corners, and instead are supporting the weight from the end walls containing the handles. Therefore, additional points of strength are required. Modular furniture typically does not have strong bottom corner joinery or handles. Even the panels of modular furniture, commonly made of particleboard, are not designed for heavy-duty use. Most modular furniture is intended to be disassembled for moving, or protected with packaging to avoid chips and breaks. Modular furniture is therefore not intended to be used as a moving or storage container.

In contrast to typical modular furniture and storage containers, a strong, lightweight bottom wall 16 is formed by the layering of the shell and interior components 46. As best shown in FIG. 5A, the core bottom 90 comprises one layer of the bottom wall. The inner panel bottom 100 comprises an additional layer. A strong bottom corner joint 110 is formed where the core bottom 90 hingedly connects to the core end walls 94 by the core hinge 96. Because the core hinge 96 does not require separation between the bottom 90 and end walls 94, high strength may be achieved that is greater than glued, screwed, or stapled joints found in most modular furniture.

Moreover, the interior layers 46 need not be heavy in order to provide adequate strength. In various exemplary embodiments utilizing paper honeycomb, the overall weight is light while being unexpectedly strong. The hybrid unit 10 also appears substantial due to the thickness of the shell and internal components 46. This way the hybrid unit has the appearance of traditional furniture. Typical storage and moving containers, in comparison, have relatively thin walls not suitable for displaying as furniture. When the base 12 is lifted, however, it is light weight. Thus, the hybrid unit 10 has an unexpectedly high strength to weight ratio not found in typical furniture or storage containers.

In various exemplary embodiments, the handle flaps 62 assist in converting the hybrid unit 10 from a storage container to a modular furniture unit. As discussed above, the handle flaps 62 are disposed in the shell end-wall 54. When desired, the handle flaps 62 may remain unfolded, providing a continuous pattern 50 and hiding the interior layers 46 and the chamber 22 from external view. When needed, the flaps may be folded in to provide handles for easy carrying.

Figure 5B:
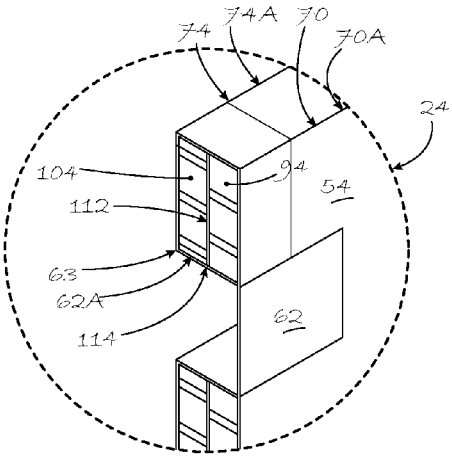
FIG. 5B is a perspective, magnified view of an exemplary handle shown in FIG. 5A.
Figure 5C:
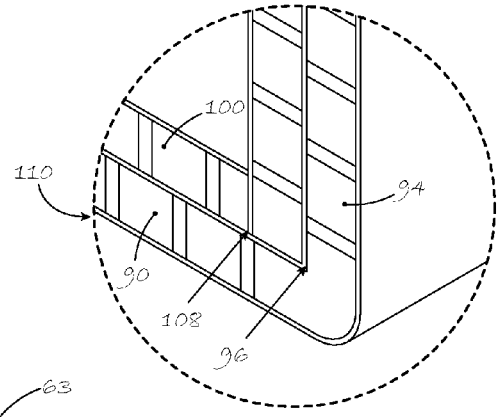
FIG. 5C is a perspective, magnified view of an exemplary corner joint shown in FIG. 5A.
Figure 5D:
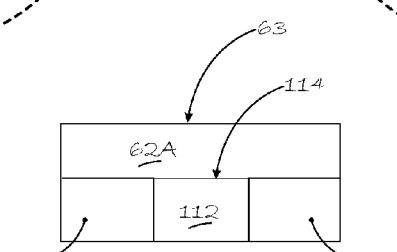
FIG. 5D is a plan, magnified view of an exemplary handle flap shown in FIG. 5A.

As best shown in FIG. 5B, a handle flap 62A may also include a secondary flap 112. In an exemplary embodiment, the secondary flap 112 is formed approximately halfway down the handle flap 62A. The secondary flap 112 may be about half the width of the handle flap 62A and centrally disposed. The secondary flap 112 is folded inwards along a secondary flap hinge 114 and may tuck between the core layer 88 and inner panels 98. In an exemplary embodiment, the secondary flap 112 is provided on the interior side of the base 12.

Figures 6A, 6B:
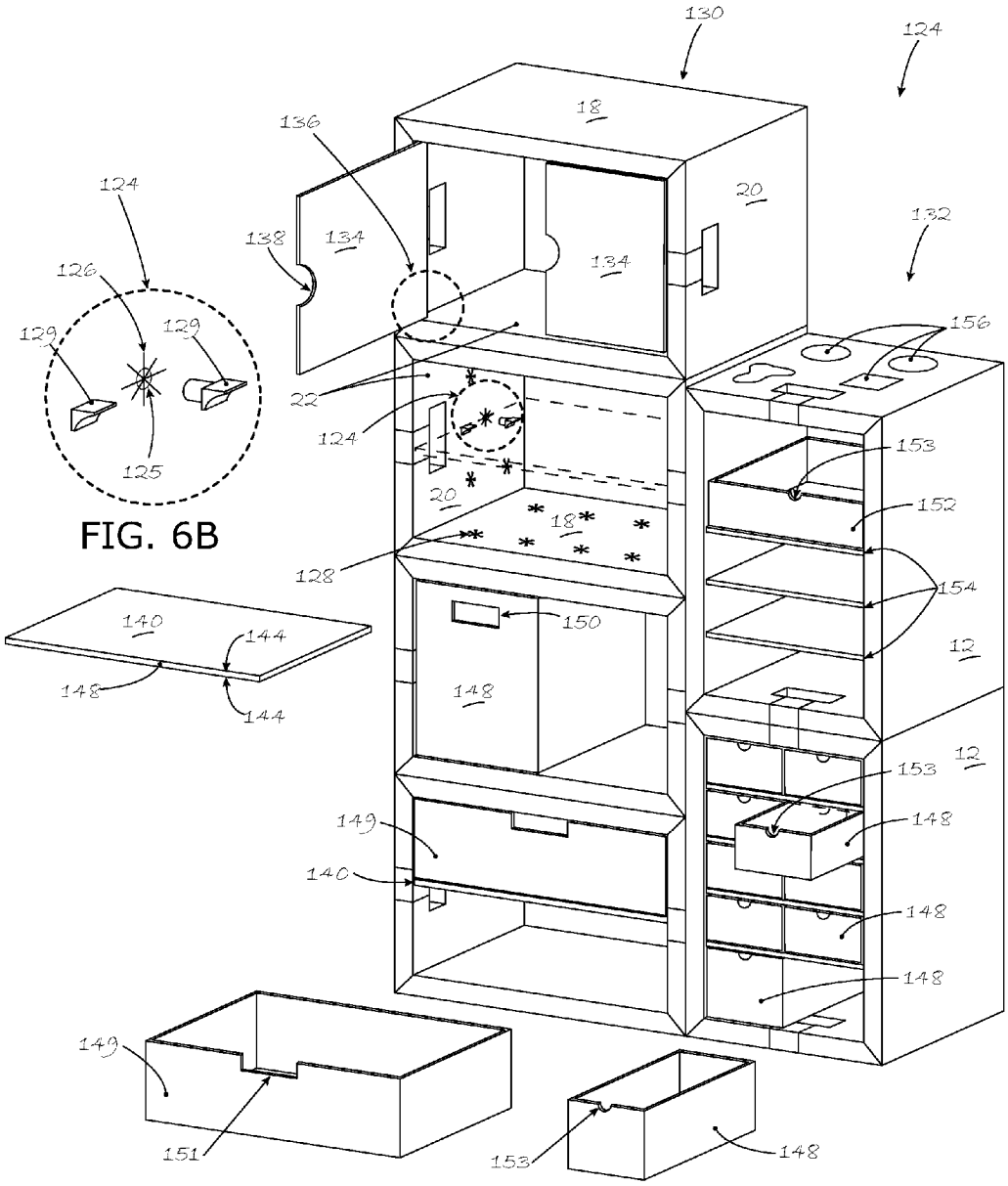
FIG. 6A is a perspective, assembly view of multiple exemplary hybrid units of FIG. 1 configured as modular furniture.
FIG. 6B is a perspective, assembly view of an exemplary door hinge.

As best shown in FIG. 6A, a base 12 may be stacked with similar or identical bases 12 to form various furniture configurations, for example a shelving unit 120. Storage containers typically must be un-stacked and un-lidded to retrieve stored items. By arranging the bases 12 into the shelving configuration 120, the bases 12 are easily converted from storage containers to furniture so that items contained therein may be both easily packed and moved and then accessed once in a final location. The final configuration may depend on the type of items to be stored in the bases 12, as well as the overall function desired. For example, the bases 12 can be configured to serve as bookcases, media consoles, nightstands, dressers, desks, etc.

Assembled in the exemplary shelving configuration 120, the chambers 22 face out and may be compartmentalized with various internal members 122 such as shelves, bins, cabinet doors, trays, and dividers as described in further detail below. The internal members 122 organize the chambers 22 and allow for easy item storage and retrieval. Various supports 124 may be associated with the interior side-walls 18 and end-walls 20 to support the internal members 122. The internal members 122 may be made of various combinations of corrugated cardboard, paper honeycomb panels, or various other cellulosic materials. The internal members 122 also may be made from or include fabric, plastic, metal, wood, or other materials.

In an exemplary embodiment, radially cross-hatched slits 126 are formed in the walls of the base 12. The cross-hatched slits 126 may be disposed in rows and columns across the side-walls 18 and end-walls 20 as best shown in FIG. 6A. The cross-hatched slits may be formed in the shell 44. Behind the cross-hatched slits 126 are a corresponding set of holes 125 formed into the corresponding interior 98, for example end wall panels 104. In an exemplary embodiment, plastic pegs 129 are slideably inserted into the slits 126 and holes 125. The pegs 129 may have an approximately L-shaped cross section with a round protrusion extending therefrom. The weight of the internal members 122 and items placed in or on the internal members 122 is transferred down the pegs 129 and pressed upon the side-walls 18 and/or end-walls 20 of the base 12. The multiple rows and columns of holes 125 and slits 126 provide options for different placements or positions of the internal members 122. When not in use, the cross-hatched slits 126 provide a near uniform surface appearance, as opposed to an uncovered opening. In various exemplary embodiments, various other components may be used to support the internal members 122. For example, channels, rails, slides, saw-toothed ledges, and other components can be utilized to support internal members and/or facilitate a sliding connection with various internal members 122.

As best shown in FIG. 6A, the bases 12 may be formed in two columns. The left column 130, contains four horizontally oriented and stacked bases 12. The right column 132, contains two vertically oriented and stacked bases 12. The two columns 130, 132 contain an assortment of internal members 122. In an exemplary embodiment, the top base 12 of the left column 130 includes two cabinet doors 134 enclosing the chamber 22. The cabinet doors 134 may also be a single door which fully or partially encloses the chamber 22, hinged on either the left side, right side, top or bottom. The cabinet doors 134 may be made from a light-weight panel material, for example a composite wood material, although other materials may be used. The cabinet doors 134 are connected to the side-walls 18 at the front edge of the chamber 22 by a pair of hinges 136 running parallel with the vertical direction of the horizontally oriented end-walls 20. Various exemplary embodiments of hinges 136 are shown in FIGS. 6B-6E.

FIG. 6B depicts an exemplary hinge 136B that has a rod 137B slideably inserted into a socket 139B in the cabinet door 134. Attached to the rod 137B is a sliding button 141B. A spring 143B is placed in the socket 139B which urges the rod away from the cabinet door 134 and into the base 12. The sliding button 141B allows the hinge 136B to be refracted into the cabinet door 134 so that the cabinet door 134 can be removeably placed into the chamber 22. When the sliding button 141B is released, the spring 143B presses the rod 137B into an opening in the base 12.

Figure 6C:
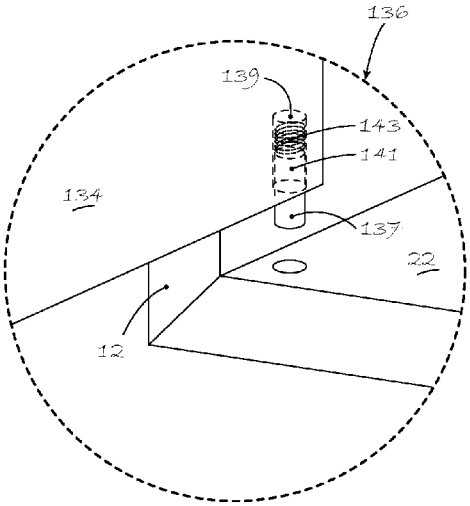
FIG. 6C is a perspective, assembly view of an exemplary door hinge.

FIG. 6C depicts an exemplary hinge 136C having a rod 137C that is slideably inserted through an exterior opening 145C in the base unit side-wall 18 or end-wall 20. Once through the opening 145C, the rod 137C enters a socket 139C in the cabinet door 134. In an exemplary embodiment the rod 137C includes a flange 147C. The flange 147C rests on the exterior surface of the base 12 where it is inserted. The area around the opening 145C in the base 12 may be counter sunk so that the flange 147C sits flush with the exterior surface.

Figure 6D:
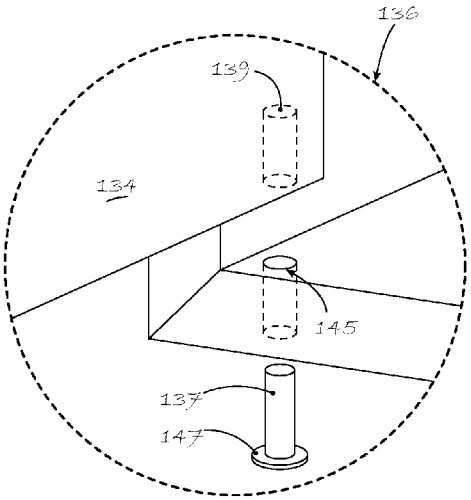
FIG. 6D is a perspective, assembly view of an exemplary door hinge.

FIG. 6D depicts an exemplary hinge 136D having a rod 137D that slides in and out of a socket 139D in the cabinet door 134. The rod 137D has a hole 153D extending into the rod 137D in a direction perpendicular to the length of the rod 137D. The cabinet door 134 also contains an opening 155D that may align with the rod hole 153D. A small peg 157D may be inserted through the opening 155D in the cabinet door 134 and extend into the hole 153D in the rod 137D, securing the rod 137D in an extended position. In an exemplary embodiment the rod 137D extends approximately 1 cm out from the cabinet door 134 and leaves approximately 1 cm of void space in the socket 139D. The peg 157D may be held in place by friction. When the peg 157D is removed, the rod 137D may slideably retract within the socket 139D to enable positioning of the cabinet door within the chamber 22. Once positioned over an opening 145D, the rod 137D falls into the opening 145D and the peg 157D is inserted into the hole 153D to secure the rod 137D in the extended position.

Figure 6E:
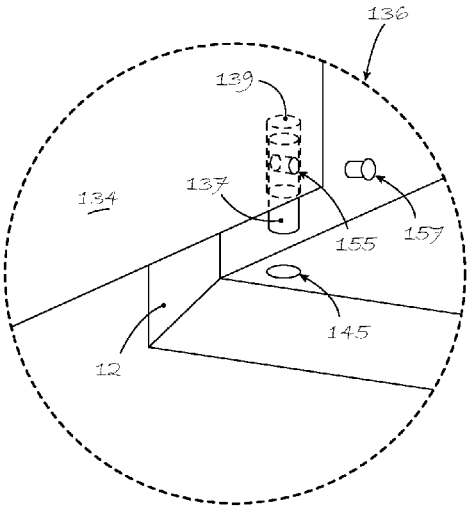
FIGS. 6E and 6F are perspective, assembly views of exemplary door hinges.
Figure 6F:
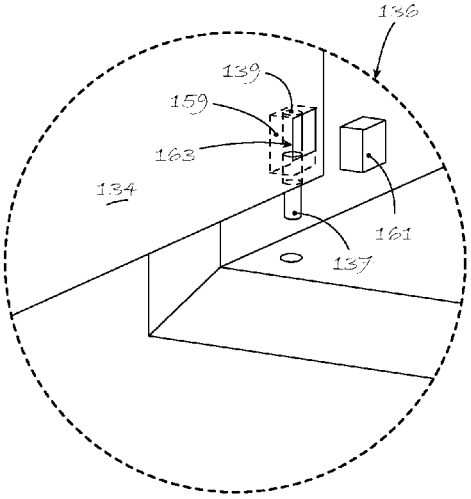

FIG. 6E depicts an exemplary hinge 136E having a rod 137E that is slideably inserted into a door socket 139E having a foam housing 159E. The foam housing 159E may be made from high density foam or other foam material. The foam housing 159E may be disposed in the bottom corner of the cabinet door 134. When the rod 137E is in the extended position, for example with roughly 1 cm extending out from the cabinet door 134, there is a void in the innermost area of the structural foam housing 159E. To fill the void and thus secure the hinge in the extended position, a foam block 161E, for example a medium density foam block, may be inserted into the void through an opening 163E in the foam housing 159E. Various other conventional hinges may also be used to connected the cabinet doors 134 and the cabinet doors 134 may be hinged in the lateral direction, with the hinges 136 connected into the end walls 20.

In various exemplary embodiments, the cabinet doors 134 may have a finger notch 138 on the edge of the cabinet door 134 that is opposite the edge containing the hinges 136. The finger notch 138 is provided to enable easier opening of the cabinet doors 134. The cabinet doors 134 may also or alternatively include knobs, pulls, slots, or other types of openers.

As best shown in FIG. 6A, the second base 12 down on the left column 130 contains a shelf 140. The shelf 140 may span the two opposing end-walls 20. In an exemplary embodiment, the shelf 140 is comprised of a single sheet of triple-wall corrugated cardboard folded at a pair of hinges 144. The space between the pair of hinges 144, may be approximately 1 cm in thickness, and form the front edge of the shelf 140. The corrugated flutes may run either parallel with or perpendicular to the fold. The shelf 140 may be slideably inserted into the base 12 where it rests on the supports 124. The shelf 140 may be made from other cellulosic materials such as paper honeycomb, or from various other materials such as metal, polymers, or composites.

The third base 12 down in the left column 130 includes a bin 148. The bin 148 may be sized to approximately fill the depth and height of the base 12, into which it is slideably insertable. The bin 148 may rest upon the lower side wall 18 of the base 12. The bin 148 may contain a handle 150 so that the bin 148 can be easily pulled from the base 12 for access. The bin 148 may constructed similar to any of the exemplary base embodiments described herein, or it may be conventionally formed in a manner known to those of ordinary skill in the art.

The fourth base 12 down in the left column 130 contains drawers 149. The drawers 149 may approximately fill the depth and length of the base 12. Drawers 149 may be slideably placed upon shelves 140 as well as upon the lower side-wall 18 of the base 12. In an exemplary embodiment, the drawers 149 fit three or more in a base 12. A drawer handle 151 may formed in the front surface of the drawer 149, so that a person's fingers would face downward to pull out the drawer 149 rather than upward. Various other handles may be utilized as discussed herein or would be known to those of ordinary skill in the art. In various exemplary embodiments, the lid 14 may double as a drawer 149 and be placed into the base 12.

The top base 12 in the right column 132 contains an exemplary tray 152. The tray 152 may approximately fill the depth and width of the base 12 into which it is slideably inserted. The tray 152 may rest on a shelf 154 that is similar in construction and operation to the shelf 140 previously described. The tray 152 may have a finger notch 153 to make it easy to pull out from the base 12. Other handles may be utilized with the tray 152 as discussed herein or would be known to those of ordinary skill in the art.

In various exemplary embodiments, the exterior surfaces of the bases 12 may have various grips 156 as shown on top of the upper right column 132. The grips 156 may be formed from a polymeric or elastomeric material, for example polypropylene, polyethylene, or rubber. The grips 156 may be various shapes and sizes and placed between stacked bases 12. The grips 156 provide traction to help prevent the bases 12 from sliding. For example, the grips 156 may provide resistance to lateral displacement that can occur when stacked or when being transported.

The bottom base 12 in the right column 132 contains multiple bins 148A. The bins 148A may be smaller than the bin 148 in the left column. For example, each bin 148A may approximately fill the depth and half the width of the base 12 into which they are slideably inserted. The bins 148A may rest upon shelves 140, 154 or walls 18, 20. The bins may also rest upon pegs 129, slides, rails, grooves, or other support members. The bins 148A may also include finger notches 153 or various other handles as discussed herein or would be known to those of ordinary skill in the art.

Other components may also be provided for use with the base unit 12. For example, a divider (not shown) may be removably insertable into the chamber 22. The divider partitions the chamber 22 vertically, horizontally, or both. The dividers may include slots for two or more dividers to interlock. The dividers may include cross-hatched slits 126 and/or openings 125 for receiving pegs 129. The dividers may also include slots, tracks, rails, or various other devices for receiving internal components 122.

FIGS. 7A to 7D depict various exemplary embodiments of the lid 14 having a top wall 28, two side-walls 30, and two end-walls 32. In an exemplary embodiment, the top wall 28 has a length of approximately 30-50 cm and a width of approximately 30-75 cm and the side and end-walls 30, 32 have a thickness of approximately 4-6 cm.

Figure 7A:
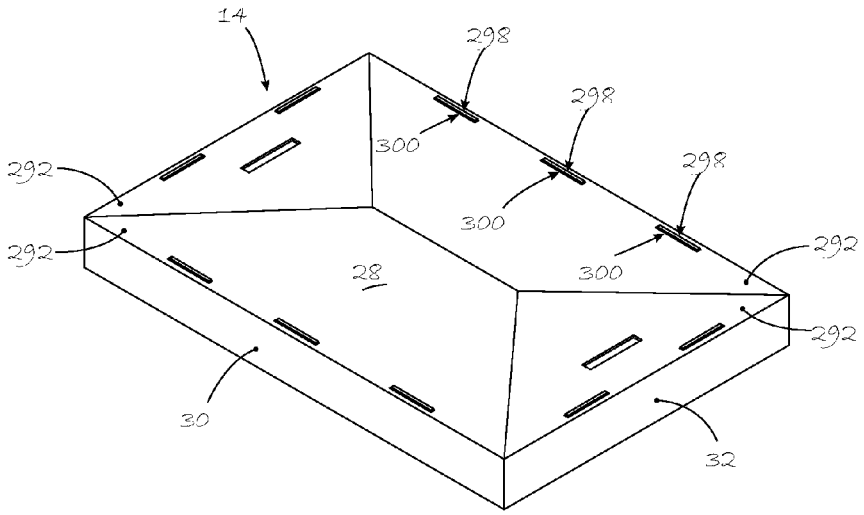
FIG. 7A is a perspective, top view of an exemplary lid.
Figure 7B:
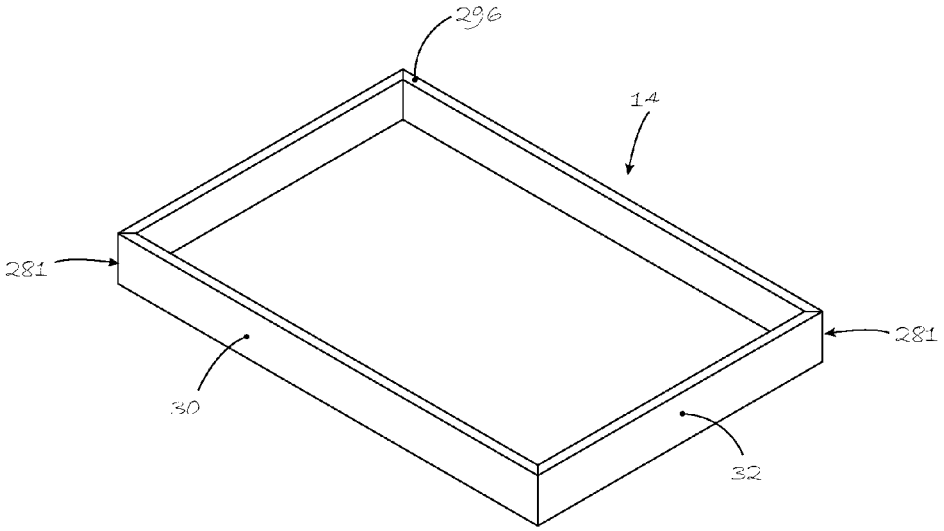
FIG. 7B is a perspective, bottom view of an exemplary lid.
Figure 7C:
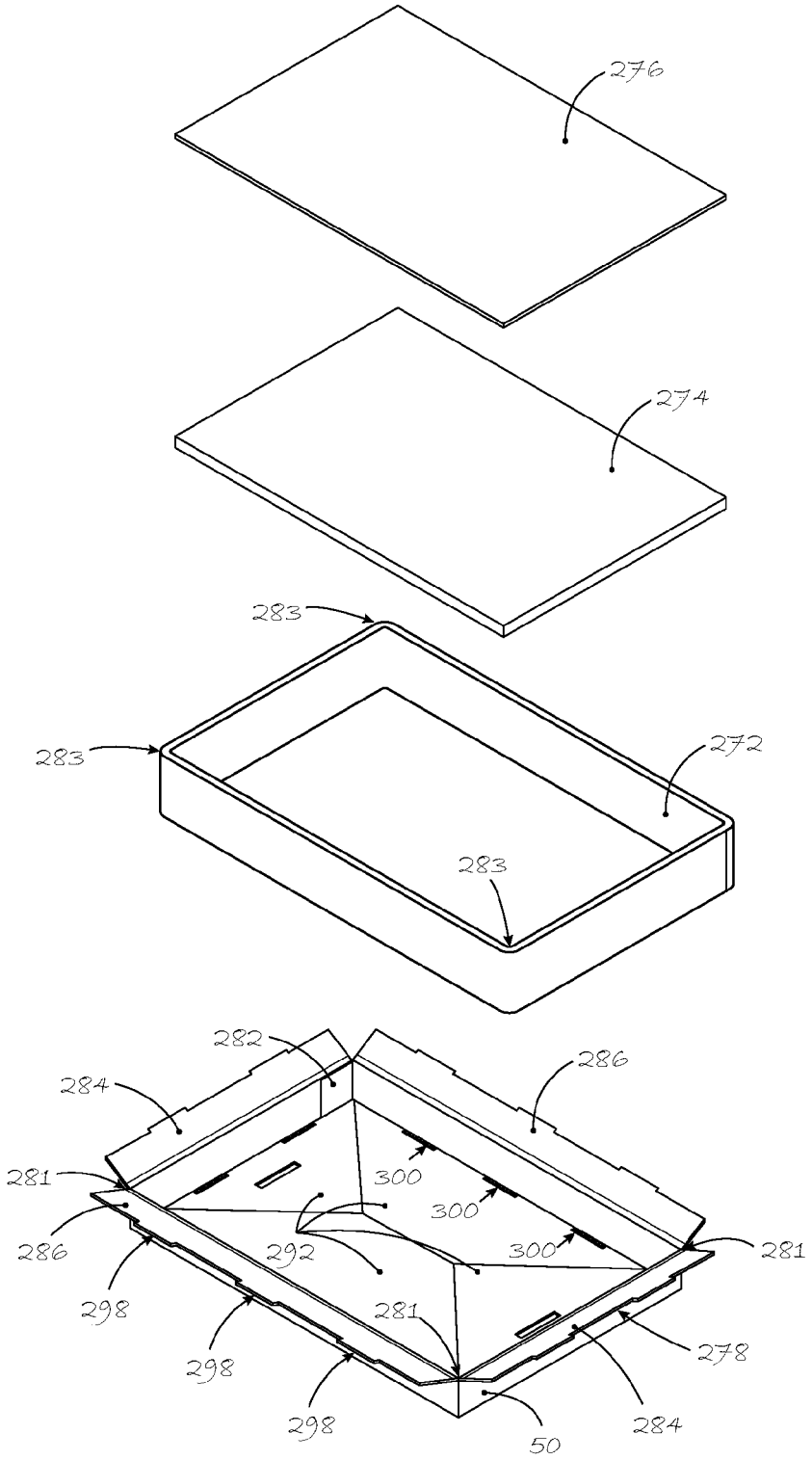
FIG. 7C is a perspective, assembly view of the exemplary lid of FIGS. 7A and 7B.

As best shown in FIG. 7C, the lid 14 may be composed of multiple parts. For example, the lid 14 may include a lid shell 270, a lid core layer 272, a lid panel 274, and a lid outer layer 276. The lid shell 270 may be constructed in a manner similar to the base shell 44. In an exemplary embodiment the lid shell 270 is made from a sheet material, such as any of those previously mentioned herein with respect to the base unit shell 44. In an exemplary embodiment the sheet material may be treated for moisture resistance, laminated, and printed with a pattern 50 as described herein with respect to the base shell 44.

The lid shell 270 has two lid shell end-walls 278 and two lid shell side-walls 280 that are connected to each other at three lid corner folds 281. The lid shell may be folded along the corner folds to place respective side-walls 280 adjacent to respective end-walls 278. A tab 282 extends from one of the walls, for example a lid shell side-wall 280. The tab 282 adheres to the inside of the adjoining lid shell end-wall 278. Alternatively, the tab could be extended from the lid shell end-wall 278 and adhere to the lid shell side-wall 280. Other means of connecting the end-walls 278 and side walls 280 may also be utilized, including adhesives or mechanical fasteners.

The lid core layer 272 may be made from a sheet of cellulosic material, for example corrugated cardboard or fluted polypropylene, though other types of materials may also be used. In an exemplary embodiment the lid core layer 272 is made from a corrugated material having the fluting or corrugation running in the lengthwise direction. The lid core layer 272 may have a bottom, similar to the core layer 88 or it may have side-walls and end-walls only. In various exemplary embodiments, the lid core layer 272 is a single strip of material having three corner folds 283. At the fourth corner the side edges of the inner layer 272 meet, for example in a butt joint 285 or in an interlocking joint. The lid core layer may utilize a tab similar to the lid shell 270 or any other connection as discussed herein or would be known to those of ordinary skill in the art.

The lid panel 274 may be made from a lightweight material, for example paper honeycomb, though other types of materials may be used. In an exemplary embodiment, the lid panel is approximately 1-2 cm thick. The lid panel 274 may be sized to fit snugly inside the lid core layer 272, so that it may be removed if necessary but not easily come loose.

The outer layer 276 may include a veneer, such as a cork veneer or other decorative types of veneer. The outer layer 276 may also include a material making it suitable for use as a chalkboard or whiteboard. The outer layer 276 may include a substrate that is covered by layer of cork material, or as discussed above with respect to the base shell 44, other types of veneer, paper, foil, or decorative laminate. In an exemplary embodiment, the outer layer 276 is roughly 2-3 mm thick.

Figure 7D:
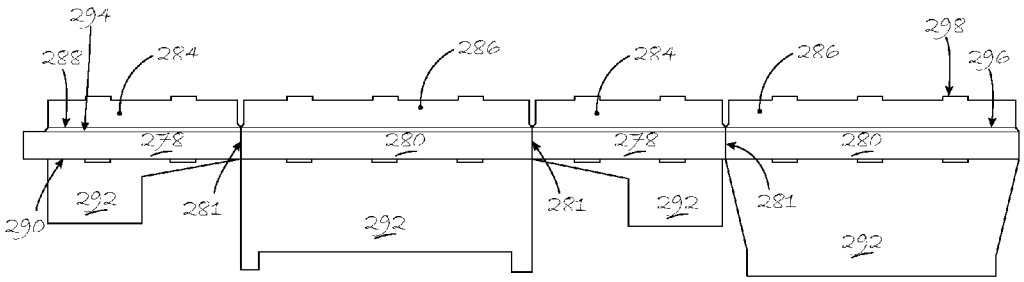
FIG. 7D is a plan view of an exemplary unfolded shell of the lid of FIGS. 7A-7C.

As best shown in FIG. 7D, the lid shell includes end-wall upper flaps 284 and side-wall upper flaps 286. The upper flaps 284, 286 may be connected to the lid shell end-walls 278 and lid shell side-walls 280 by a lid primary fold 288. The lid primary fold 288 may be a horizontal line extending the full length of the lid shell 270, approximately perpendicular to the lid corner folds 281.

A bottom fold 290 may be disposed opposite the lid primary fold 288 on the other side of the lid shell side-walls 280 and end-walls 278. The term "bottom" is herein used as relative descriptor as the lid shell 270 is shown in FIG. 7D. Bottom flaps 292 may be connected to the lid shell side-walls 280 and lid shell end-walls 278 at the bottom fold 290. The bottom flaps 292 may be folded and locked together in a one-two-three-four flap style, eliminating the need for adhesive to hold them together. However, other styles of interlocking or non-interlocking may be used, including adhesives and mechanical fasteners.

The lid shell 270 may also include a lid secondary fold 294. In an exemplary embodiment, the lid secondary fold 294 is parallel to and spaced approximately 1 cm from the lid primary fold 288. As best shown in FIGS. 7B and 7D, a lid transition portion 296 is bounded by the primary and secondary folds. The transition portions 296 may include angled portions, for example 45 degree angles. The transition portions 296 may overlap at the shell corners 281, in similar fashion to the base shell transition portions 84. When assembled, the lid shell upper flaps 284, 286 may fold over the lid core layer 272, with the transition portions 296 forming a bottom edge. In various exemplary embodiments, the bottom flaps 292 may touch the major planar surface of the lid panel 274 and the edges of the lid panel 274 may touch the interior side major planar surfaces of the lid shell upper flaps 284, 286. The shell 270, corner folds 281, and transitions portions 296 provide a relatively seamless and attractive appearance to the lid 14.

In various exemplary embodiments, the lid shell 270 may also include a series of tabs 298 extending from the distal end of the upper flaps 284, 286. The tabs 298 may fold into a series of correlating slots 300 in the top wall 292 of the lid shell 270. As best shown in FIG. 7A, when assembled, the series of tabs 298 extend through their correlating slots 300 in the shell bottom flaps 292.

In various exemplary embodiments, the lid 14 may be used as more than a lid 14 for the hybrid unit 10. For example, the lid 14 may be used as a frame suitable for hanging and displaying art or other items. To mount the lid 14 to a wall or other surface, a person may hammer a nail through the lid shell 270 prior to placing the lid core 272 or lid panel 274 within the lid shell 270. The lid 14 may also come with a mechanical fastener or hanger which allows the lid 14 to be hung from a nail or connected to a wall or surface in any known fashion. The lid panel 274 and/or lid outer layer 276 may also provide a tackable surface for attaching papers and items to the lid 14, using thumbtacks or other objects, or a writeable surface for taking notes and displaying messages. The lid panel 274 or lid outer layer 276 also may be provided with artwork already printed onto its surface or otherwise provided with a decorative appearance. In an exemplary embodiment, the lid panel 274 has a frame or decorative appearance and the lid outer layer 276 includes a tackable surface such as cork and/or writeable surface, such as chalkboard or whiteboard. The lid outer layer 276 may be placed into the lid 14 when a tackable/writeable surface is required and removed when the lid 14 is to be used as a frame or for decorative purposes.

In various exemplary embodiments, the lid 14 may also function as a serving tray. The outer layer 276 may have a surface which reduces the chance of slipping so that drinks do not slide around during transportation. The same cork veneer as discussed above may provide this function or other non-slip surfaces, such as a polymeric material may be used. The outer layer 276 may also have various indentations or recessed portions to accommodate standard glassware. For example, a first surface of the outer layer 276 may be flat while the second surface has circular indentations.

The lid panel 274 may also provide rigidity and strength to the lid beyond what is found in typical boxes or modular furniture. Smaller sized boxes may be stacked on top of the lid 14 during moving. Due to the rigidity of the lid panel 274 weight is dispersed to the edges of the hybrid unit 10. The edges of the hybrid unit 10 may be stronger than the center, because they are supported by the side and end walls 18 20, where the center area of the lid may be over an open storage chamber. The lid panel 274 thus adds strength and versatility.

Figure 8A:
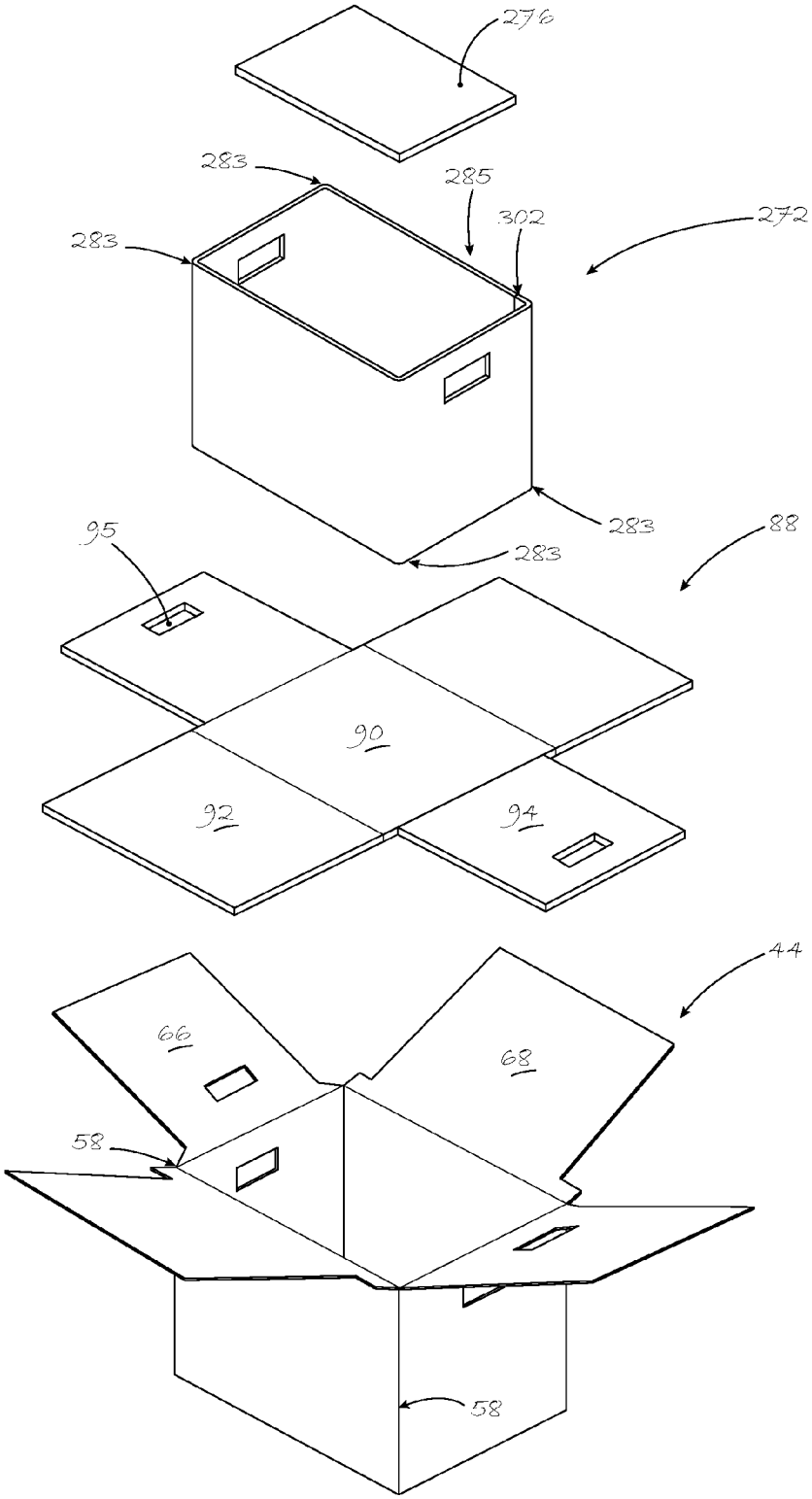
FIG. 8A is a perspective assembly view of an exemplary base.
Figure 8B:
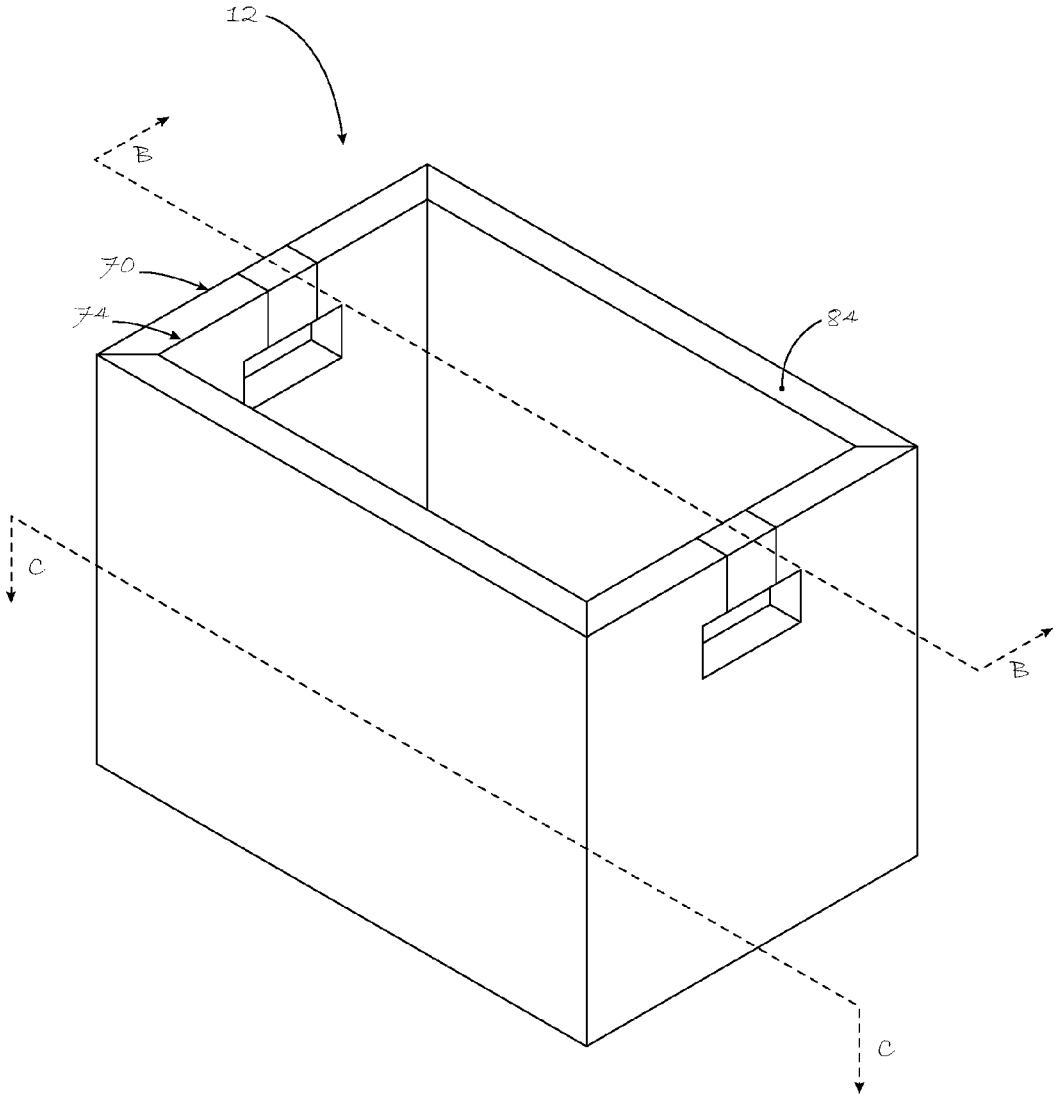
FIG. 8B is a sectional, magnified view of the exemplary base shown in FIG. 8A.
Figure 8C:
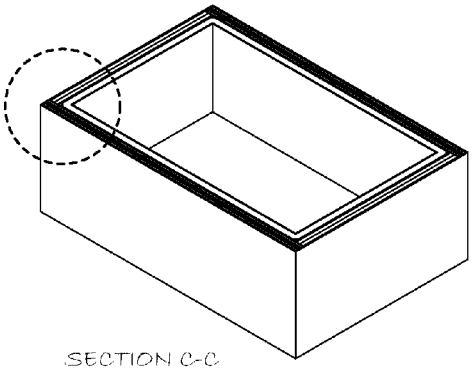
FIG. 8C is a perspective view of the exemplary base shown in FIG. 8A.
Figure 8C:
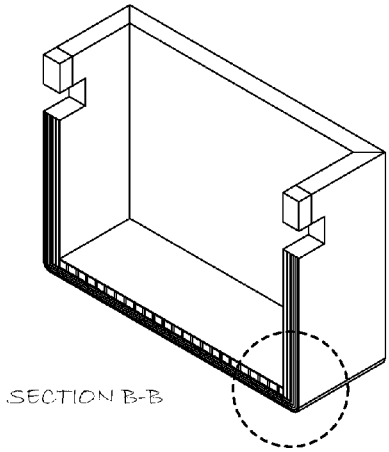
Figure 8C:
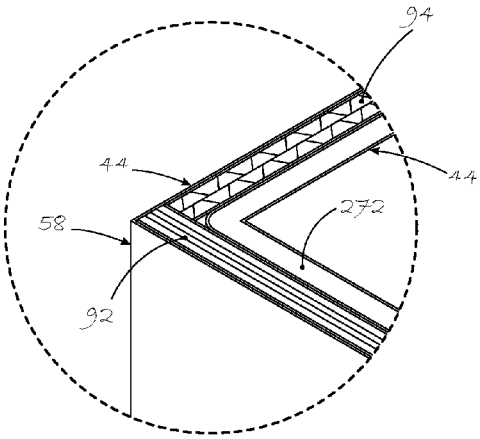
Figure 8D:
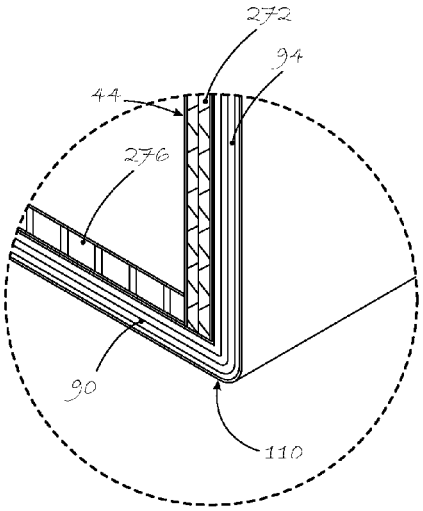
FIG. 8D is a sectional, magnified view of the exemplary base shown in FIG. 8C.

FIG. 8A depicts an exemplary embodiment base 12B, including a shell 44B, a core layer 88B, an inner layer 302, and an optional bottom panel 304. The inner layer 302 may be made of a cellulosic material, for example triple-wall corrugated cardboard, though other polymer or composite materials may be used, for example fluted polypropylene. In an exemplary embodiment, the inner layer 302 is made from a single strip of material having flutes running in the lengthwise direction of the material. The inner layer 302 may have three corner folds 306. At a fourth corner the side edges of the inner layer 302 meet, forming a corner joint 308. The corner joint 308 may be a butt joint or various interlocking joints. In an exemplary embodiment, the inner layer 302 has a tab (not shown) which may be adhered or inserted into a portion of the inner layer 302. The inner layer 302 fortifies the corner folds 58B of the shell 44B. The inner layer 272 may also increase tear resistance for when internal components 122 are pulled from the base 12B. Moreover, the inner layer 302 provides edge crush-resistance to the side and end walls when they are stacked into furniture configurations 120.

The shell 44B may be folded together or otherwise attached as discussed above. The core layer 88B and the inner layer 302 may then be inserted into the shell 44B. The shell 44B folds over the core layer 88B and inner layer 302 in the manner previously described above. In various exemplary embodiments, the distal ends of the shell upper flaps 66B, 68B may be provided with tabs for inserting into the shell 44B similar to those described herein with respect to the lid 14.

In various exemplary embodiments, a bottom panel 304 is placed into the base 12B adjacent the core bottom 90. The shell upper flaps 66B, 68B may be held in place by the edges of the bottom panel 304, the upper flaps 66B, 68B being sandwiched between the bottom panel 304 and the inner layer 302. Alternatively, a series of tabs may be provided along the distal edge of the upper flaps 66B, 68B that fit into slots in the core bottom, or through other suitable means. The bottom panel 304 may be provided with a decorative aspect, veneer, laminate, or other appearance or material as discussed above.

Figure 9A:
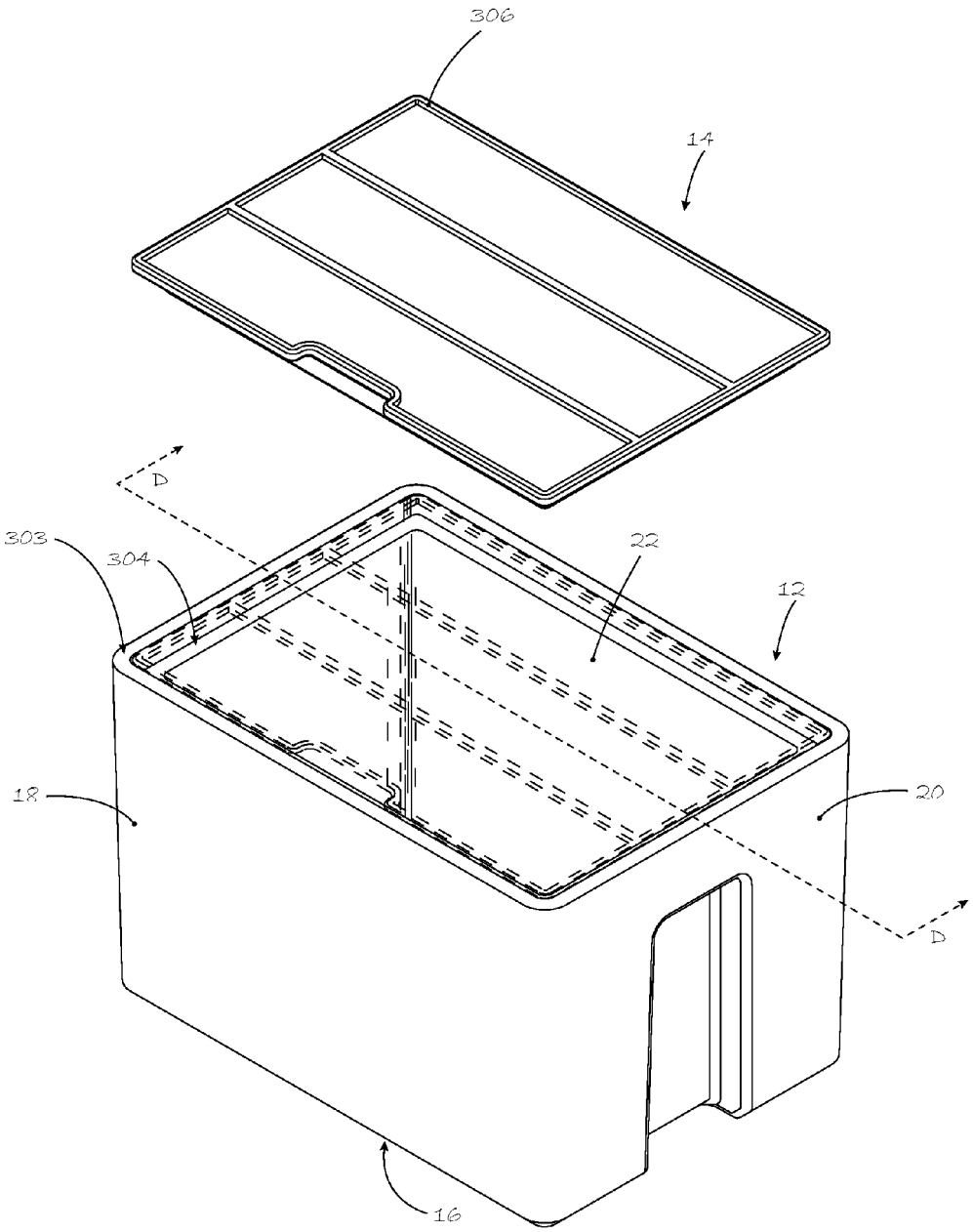
FIG. 9A is a perspective, assembly view of an exemplary hybrid unit.

FIG. 9A depicts an exemplary embodiment of a base 12C formed from a polymeric material such as polypropylene or polyethylene. The base 12C may also be made from expanded polypropylene (EPP) which enables the base 12C to be lighter in weight than traditionally processed polypropylene, without substantially compromising the strength. Various compositions are suitable for constructing the container base 12C and lid 14C and include, but are not limited to, substantially impermeable materials such as expanded polyolefin, expanded polyethylene, other polymers, wood and paper materials, wood foams, ceramic foams, soy based materials, etc. The method of forming will be dependent on the material used, and will be understood by those of ordinary skill in the art.

Figure 9B:
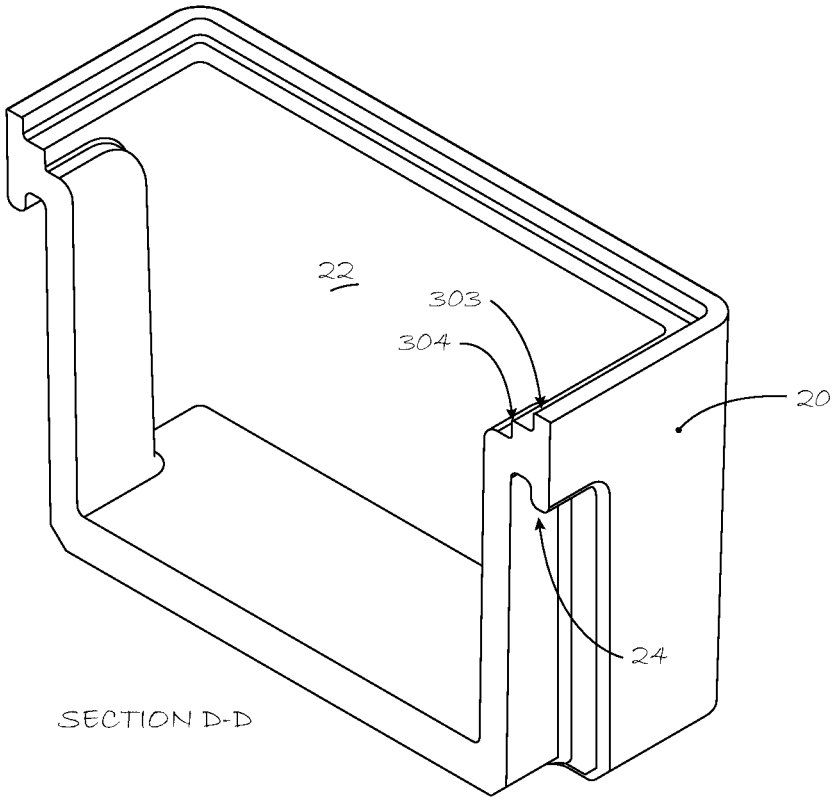
FIG. 9B is a sectional, magnified view of the handle of the exemplary base of FIG. 9A.

The side walls 18C, end walls 20C, and bottom wall 16C of the base 12C may be integrally molded or they may be formed separately and connected together. In an exemplary embodiment, the walls 16C, 18C, 20C are roughly 2-4 cm in thickness. The base 12C has substantial rigidity for functioning as furniture. For example, the density of EPP can be adjusted in the molding process to increase or decrease the rigidity of the walls 16C, 18C, 20C as needed. Handles 24C also may be molded into the end walls 20C, as best shown in FIG. 9B.

In various exemplary embodiments, an upper rim 303 surrounds the chamber 22C around the upper most edge of the side walls 18C and end walls 20C. The upper rim 303 may have a recessed lip 304. The recessed lip 304 may have a depth of approximately 1-2 cm and a thickness of 1-2 cm within the interior facing side of the upper rim 303. As shown in FIG. 9A, the recessed lip 304 serves as a resting place for an exemplary embodiment of a lid 14C. The lid 14C may include a peripheral edge flange 306 that rests within the recessed lip 304 so that the lid 14C sits flush with the upper rim 303. The lid 14C may be molded from plastic material such as polyethylene or polypropylene, or it may be made from any other type of moldable material. The lid 14C comprises a generally rectangular, planar surface. In an exemplary embodiment, the lid 14C is approximately 1-2 cm thick at the edge flange 306 and has ribbing 308 on the bottom side. A portion of the edge flange 306 may be recessed, forming a hand notch 310, to accommodate removal of the lid 14C from the base 12C.

Figure 10A:
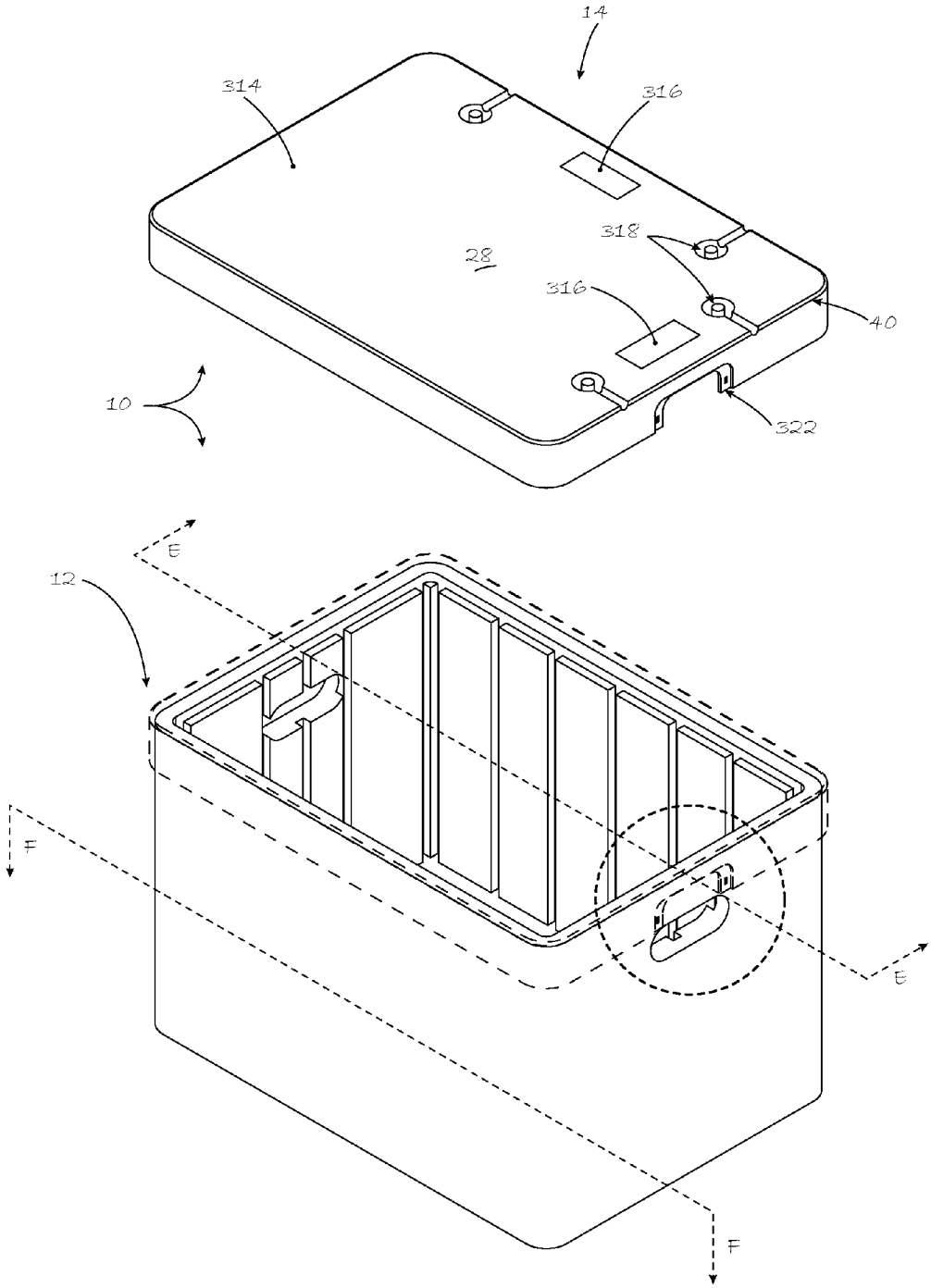
FIGS. 10A and 10B are perspective, assembly views of an exemplary hybrid unit and of an exemplary lid, respectively.
Figure 10B:
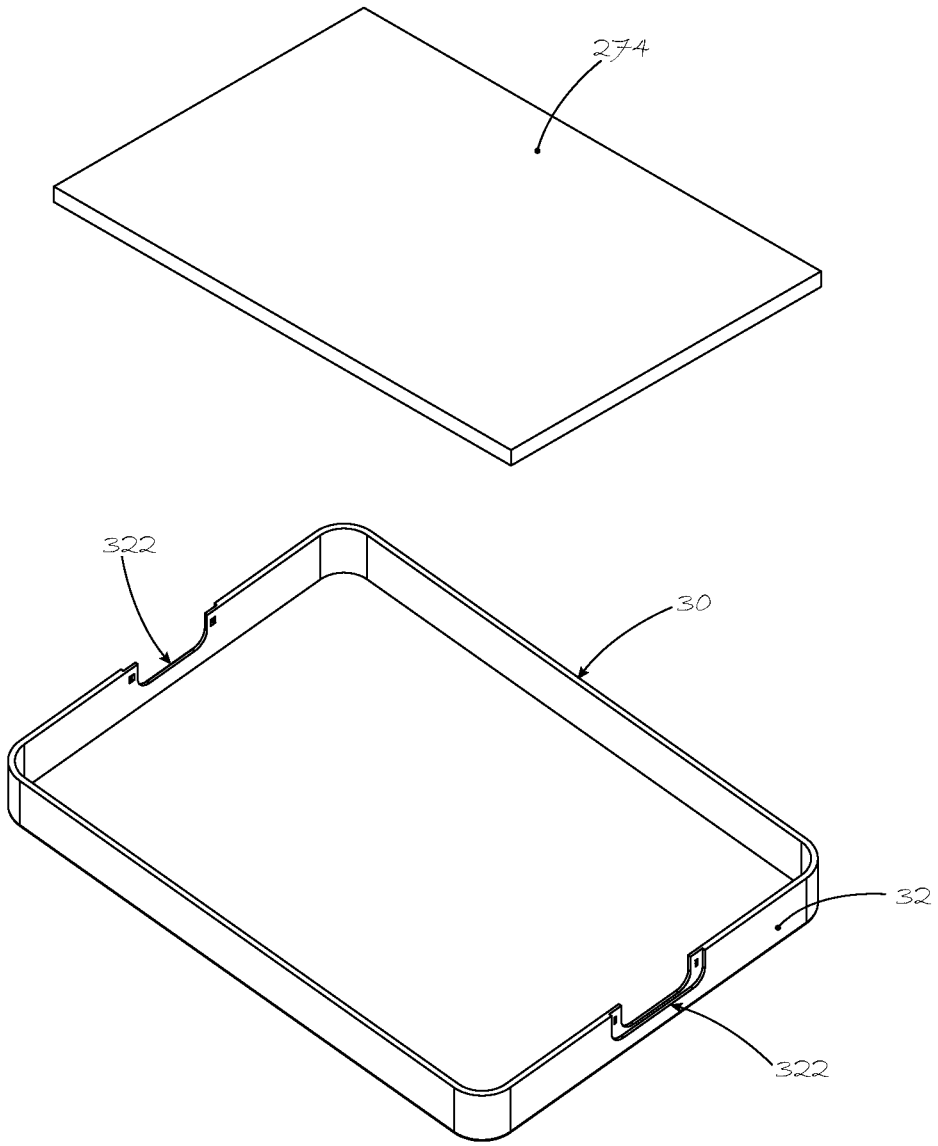
Figure 12:
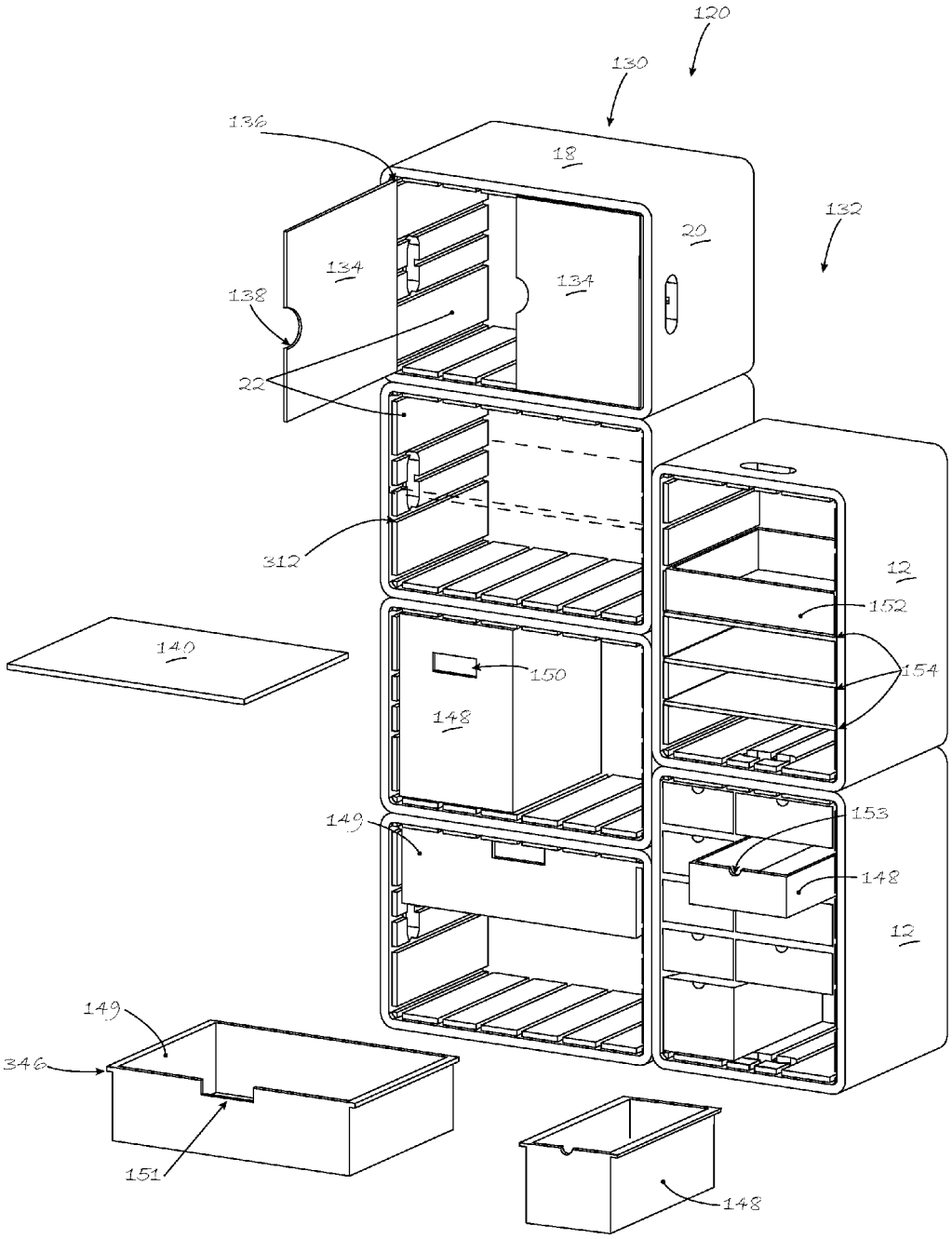
FIG. 12 is a perspective, assembly view of multiple exemplary hybrid units of FIG. 10A configured as modular furniture.
Figure 13A:
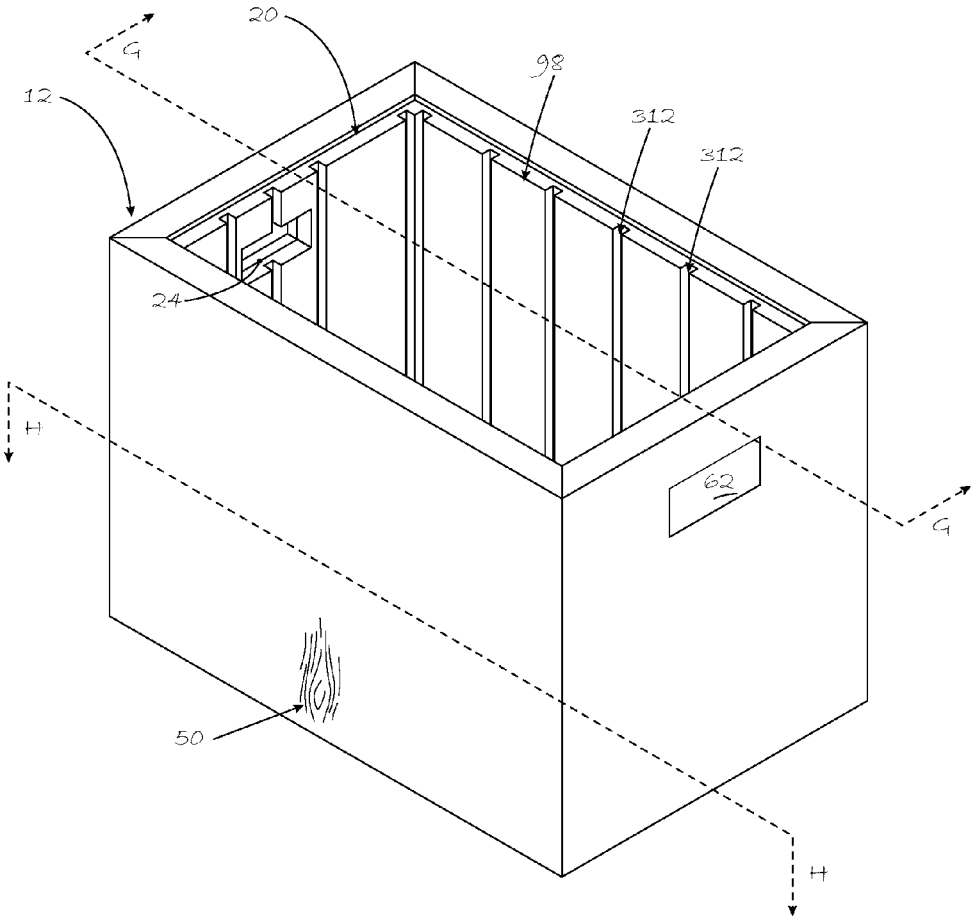
FIG. 13A is a perspective assembly view of an exemplary base.
Figure 13B:
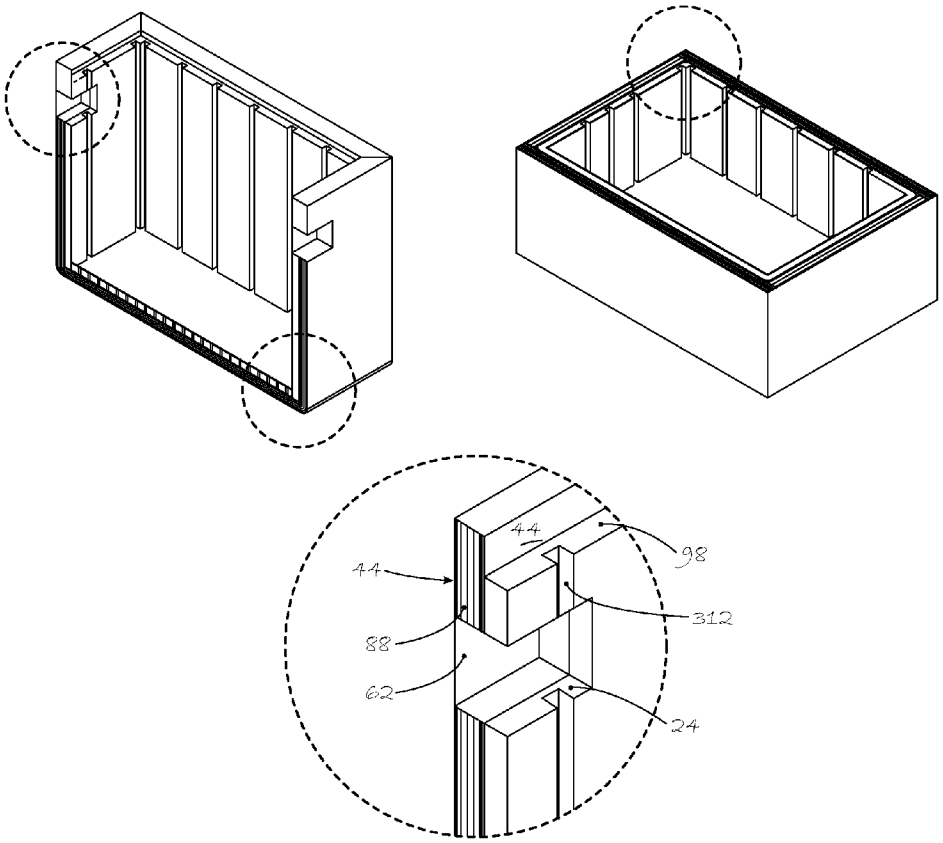
FIG. 13B is a perspective, magnified view of an exemplary handle shown in FIG. 13A.
Figure 13C:
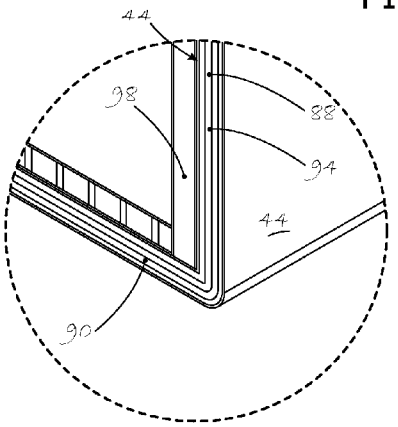
FIG. 13C is a sectional, magnified view of an exemplary corner joint shown in FIG. 13A.
Figure 13D:
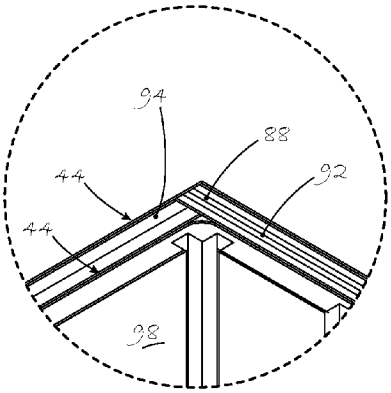
FIG. 13D is a sectional, magnified view of the exemplary base shown in FIG. 13A.

FIG. 10A depicts an exemplary embodiment of the hybrid unit 10D. The hybrid unit 10D may be made from any of the materials and have similar structure to those discussed herein. Handles 24D may extend through the end walls 20D and can be formed through cutting or during a molding process. Spaced grooves or channels 312 may be arranged on the interior side walls 18D and end walls 20D. The channels 312 may extend from the recessed lip 304 down to the bottom wall 16D of the base 12D. The channels 312 may be formed during the molding process or subsequently formed into the walls 18D, 20D, for example through machining or pressing. As best shown in FIG. 12, the channels 312 may support internal components 122B such as shelves, bins, trays, drawers, etc. The depth of each channel 312 may be about half the thickness of the sidewall 18D or end wall 20D in which it is contained. In an exemplary embodiment, each end wall 20 contains five channels 312 with respective channels opposite one another, and each side wall 18D contains seven channels 312 each with respective channels opposite one another. More or fewer channels, however, may be provided.

Similar to the lid 14 discussed above, the lid 14D shown in FIG. 10A has the ability to function as a frame on the wall and/or a tray for serving drinks and food. The lid 14D has a top wall 28D, end walls 32D, and side walls 20D. The lid 14D may be composed of molded plastic or other moldable material. The lid 14D may also contains a lid panel 274D for functioning as a cork board. In an exemplary embodiment the lid panel 274D is composed of a sheet of molded or cut EPP or a structural foam material.

In an exemplary embodiment, the top wall 28D has a textured surface 314. The textured surface 314 may extend almost the entire surface area except for predetermined areas having a glossy texture 316. The textured surface 314 is provided for traction when multiple containers are stacked upon each other vertically. The textured surface 314 helps the hybrid units 10D resist sliding off each other when stacked, for example while in a moving vehicle or when assembled as furniture.

The glossy areas 316 provide places to facilitate connecting the lid 14D to a wall or other surface for hanging, for example with double-sided tape or an adhesive. The glossy areas 316 allow easier removal of adhesive than the textured surface 314. The lid 14D may also or alternatively include recessed pegs 318. The pegs 318 may be molded so that an outer surface of the pegs 318 is flush with the top wall 38. Channels 320 extend between the edge of the lid 40 to the area around the pegs 318. Picture hanging wire may be tied around the pegs 318 for hanging the lid on a wall. The pegs 318 may vary in amount and placement so that the lid 14D may be hung in a vertical or horizontal orientation.

Figure 11A:
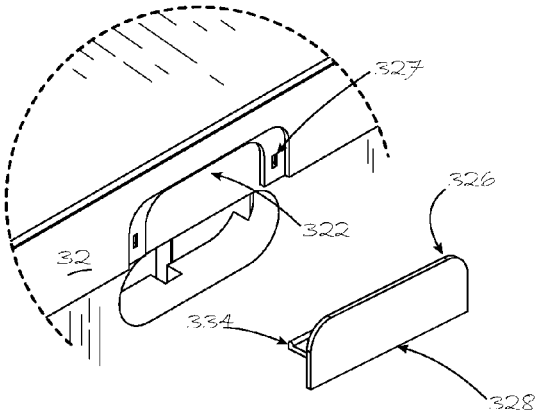
FIG. 11A is a perspective, assembly view of an exemplary lid and handle.
Figure 11A:
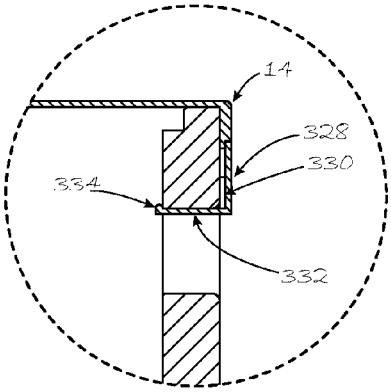
Figure 11B:
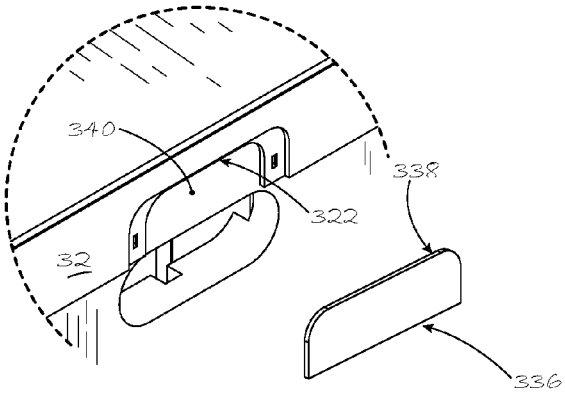
FIG. 11B is a perspective, assembly view of an exemplary lid and handle.
Figure 11C:
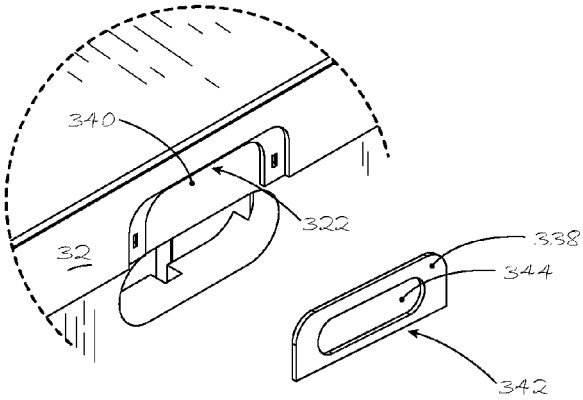
FIG. 11C is a perspective, assembly view of an exemplary lid and handle.

In various exemplary embodiments, the lid 14 contains an opening 322 on each side. The opening 322 may be disposed at the approximate center of the lid end walls 32. The opening 322 may receive a handle mechanisms 324, for example interchangeable handle mechanisms 324 as shown in FIGS. 11A-11C. The handle mechanisms 324 may be made of metal, plastic, wood, or a cellulosic material. In an exemplary embodiment the handles 324 are made from injection molded plastic. Apart from serving as handles, the handles 324 may enhance different functionalities of the lid 14, as a lid, as a frame, and/or as a serving tray.

As best shown in FIGS. 11A-11C, the handles 324 may connect to the lid 14 through a snap fit connection, though magnetic, slidable, rotatable, keyhole, latchable, or other suitable connections may be used. When a snap fit connection is utilized, a surface of the handle may have one or more protrusions 326 that mate with openings 322 in the lid end walls 32. Depending on the desired functionality, the handle 324 may be interchanged or transferred to a different orientation.

The exemplary handle 328 depicted in FIGS. 11A and 11AA includes a latch for securing the lid 14 onto the base 12. The latch handle 328 may include a first, substantially vertical leg 330 which meets with a second, substantially horizontal leg 332. The legs 330, 332 intersect and may form a substantially L-shape. The horizontal 332 and vertical legs 330 may have planar surfaces. In an exemplary embodiment, the vertical and horizontal legs are approximately 2 mm thick. The horizontal leg 332 may have approximately the same length as the thickness of the base end-wall 20 or as the combined thickness of the base unit end-wall 20 and the lid end-wall 32. The distal edge of the horizontal leg 332 may have a ridge 334. The ridge 334 may be a raised portion or thicker region of the horizontal leg 332, or it may be material that extends substantially perpendicular to the horizontal leg 332. When the lid 14 is used in combination with the base 12, the horizontal leg 332 is inserted into the handle 24 and the protrusions 326 are mated with openings 322. When connected to the lid 14, the ridge 334 may contact the interior upper edge 36 of the handle 24, as best shown in FIG. 11AA.

The exemplary handle 336 depicted in FIG. 11B may be connected to the lid 14 when it is used as a frame, decorative article, or post board. Accordingly, the handle 336 may improve the appearance of the lid 14. The handle 336 has an inner surface 338 that attaches to the opening 322 in the lid end walls 32, for example through a snap connection as described above. The handle 336 may have a decorative outer surface 340 and sit flush with the exterior surface of the lid end walls 32.

The exemplary handle 242 depicted in FIG. 11C may be connected to the lid 14 when it is utilized as a tray. The tray handle 342 has an inner surface 338 that connects to the lid end-wall 32 in a suitable manner as described above. The tray handle 342 may have an outer surface 340 with a secondary opening 344 so that a user's fingers may be inserted into the lid 14 when the lid is inverted for use as a tray. In various exemplary embodiments, the tray handle 342 may include other knobs, loops, or pivoting members, such as a u-shaped handle, connected to the tray handle 342 to facilitate easier carrying of the tray.

As shown in FIG. 6A, the bases 12 may be stacked with other bases to form various modular furniture configurations, for example a shelving unit 120. FIG. 12 depicts an exemplary embodiment of a shelving unit 120B, utilizing the bases 12D depicted in FIG. 10A. As previously described, various internal members 122B such as shelves 140B, bins 148B, drawers 149B, cabinet doors 134B, and trays 152B may be provided to organize the chamber 22 and allow for easy item retrieval. Because the channels 312 support the internal members 122B, the need for additional supports may be reduced or eliminated.

The internal members 122B may be made of various materials previously described including plastics and natural materials, or various combinations thereof. The internal members 122B of FIG. 12 may be embodied in different forms than previously described, to utilize the channels 312. For example, the tray 152B has a flange 346 extending around its upper rim so that it may be slideably inserted into a pair of opposing channels 312 in the base unit 12D.

The left column 130B contains four horizontally oriented and stacked base units 12D. The right column 132B, contains two vertically oriented and stacked base units 12D. The top base unit 12D of the left column 130B includes two cabinet doors 134B enclosing the chamber 22D, attached at hinges 136B into the base unit 12D. The cabinet doors 134B may vary as described herein, in terms of material, orientation, door openers, and hinge 136 style. In an exemplary embodiment, the cabinet doors 134B fit into the recessed lip 304D of the rim so that the cabinet doors 134B will not swing into the chamber 22D beyond the recessed lip 304D. Additionally, magnetic closures 348 may be provided within the recessed lip 304D to hold the cabinet door 134 in place and keep it from swinging outward. The cabinet doors 134B may be used in conjunction with other internal members 122B, for example shelves 140B. The shelves front edges 142B may be flush with the recessed lip 304D, leaving space in the rim 303D for the cabinet door 134B to fit.

The second base unit 12B down on the left column 130B contains a shelf 140B. The shelf 140B spans the two opposing end walls 20D. The shelf 140B may be comprised of a molded material, for example a plastic, although other materials may be used. The shelf 140B may be slideably inserted into the base unit 12D where it rests on the channels 312.

The third base 12D down in the left column 130B includes a bin 148B. The bin 148B may be sized to approximately fill the depth and height of the base 12D, into which it is slideably insertable. The bin 148B may rest upon the lower side wall 18D of the base 12D into which it is placed. The bin 148B may contain a handle 150B so that the bin 148B may be easily pulled from the base 12D for access. The bin 148B may also have a knob, drawer pull, or extended rim. In an exemplary embodiment, the bin 148B is made from molded of plastic, though other materials may be used.

The fourth base 12D down in the left column 130B contains drawers 149B. In this embodiment, the drawers 149B approximately fill the depth and length dimension of the base unit which contains them. Drawers 149B may have a flange 346 which is slideably insertable into the base 12D via channels 312. In various exemplary embodiments, the drawers 149B are smaller, and three or more may be placed into a single base 12D. A drawer handle 151B may be cut out from the top of the front facing planar surface of the drawer 149B so that a person's fingers would face downward to pull it out rather than upward. The drawer 149B may also include a knob, pull, or other forms of handles.

The top base unit 12D in the right column 132B may include a tray 152B. The tray 152B may approximately fill the depth and width of the base 12 into which it is slideably inserted along the channels 312. The tray 152B contains a finger notch 153B to make it easy to pull out from the base 12. The notch 153B may also be a knob or other forms of handles as discussed herein or would be known to those of ordinary skill in the art.

The bottom base 12D in the right column 132B contains multiple bins 148B. The bins 148B may be smaller than the bin 148 in the left column 130. For example, each bin 148 may be approximately half the depth and half the width of the base unit 12D into which the bins 148 are slideably inserted along channels 312. The bins 148 may also contain finger notches 153 though other forms of handles may also be used.

FIGS. 13A-13D depict an exemplary embodiment of the base 12. As discussed above, the base 12 may include a shell 44, core layer 88, and inner panels 98. In an exemplary embodiment, the shell 44 is made of E flute corrugated cardboard. The shell envelops the core layer 88, as previously described. The inner panels 98, however, are not enveloped and remain outside the shell 44. The inner panels 98 sandwich the shell upper flaps 66, 68 against the core layer 88.

In various exemplary embodiments, the inner panels 98 are made of EPP having channels 312 molded therein, though other materials may also be used. The construction shown in FIGS. 12-13D allows an aesthetically pleasing replaceable shell 44, with pattern 50 and handle flaps 62 to be utilized in connection with channels 312, providing enhanced ease of use with regards to the inner components 122. It should be noted that channels may also be formed into, or attached, to any exemplary base 12, including those utilizing cellulosic material.

Figure 14A:
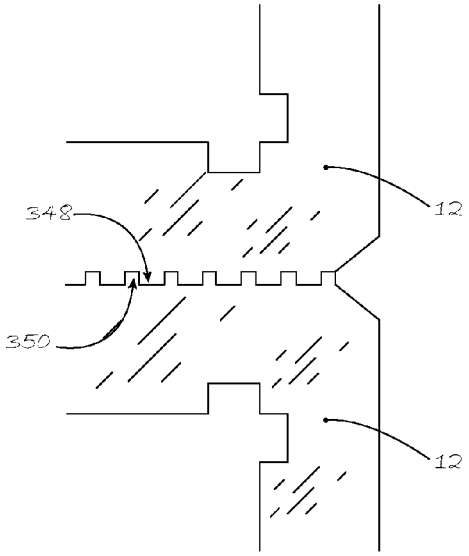
FIG. 14A is a plan, sectional view of an exemplary interlocking skin texture.
Figure 14B:
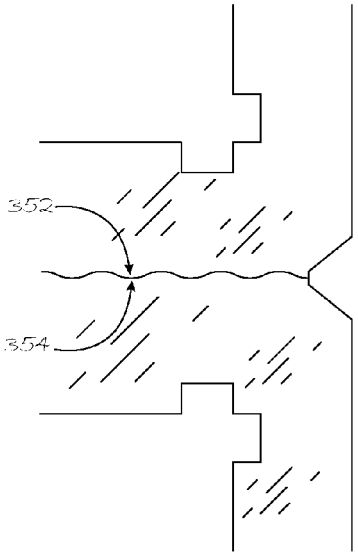
FIG. 14B is a plan, sectional view of an exemplary interlocking skin texture.
Figure 14C:
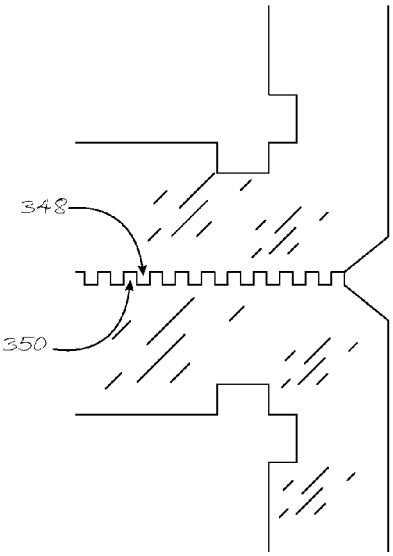
FIG. 14C is a plan, sectional view of an exemplary interlocking skin texture.
Figure 14D:
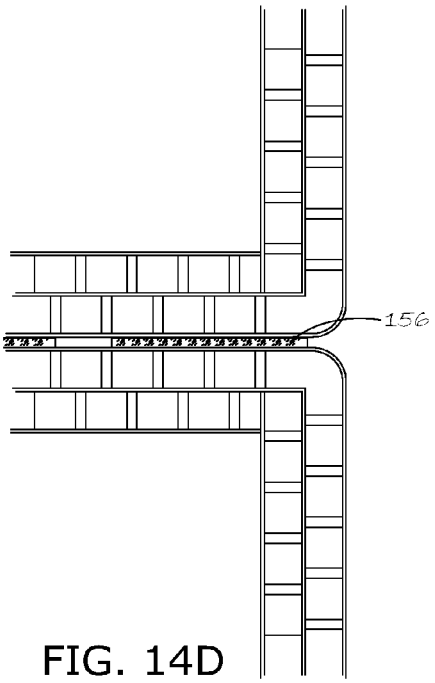
FIG. 14D is a plan, sectional view of exemplary grips positioned between two bases.

In various exemplary embodiments, the outer surface of the base 12 may be provided with structure to prevent slipping, either with other bases 12 or with various other surfaces. FIGS. 14A-14C depict various exemplary embodiments of stacked bases 12 having an interlocking skin texture. The skin texture maybe be added to the base after it is formed, for example on the surface of shell 44, or it may be integrally formed into the base 12, for example during the molding process. As best shown in FIG. 14A, the skin texture may include a mating crenellated or tooth shaped surface having protrusions 348 and impressions 350. The protrusions 348 and impressions 350 may form a generally three-dimensional checkerboard. FIG. 14B depicts a surface texture style that most closely resembles the texture of a metal grating tool, with elongated ribs 352 and channels 354. FIG. 14C depicts a skin texture similar to the one shown in FIG. 14A but on a smaller scale, with gaps between the distal end of the protrusions 348B and the impressions 350B. Various portions of the outer surface may include a skin texture and other portions may be smooth. FIG. 14D illustrates an exemplary embodiment where grips 156 are sandwiched between the base units 12 to provide traction as discussed above with respect to FIG. 6A.

Figure 15:
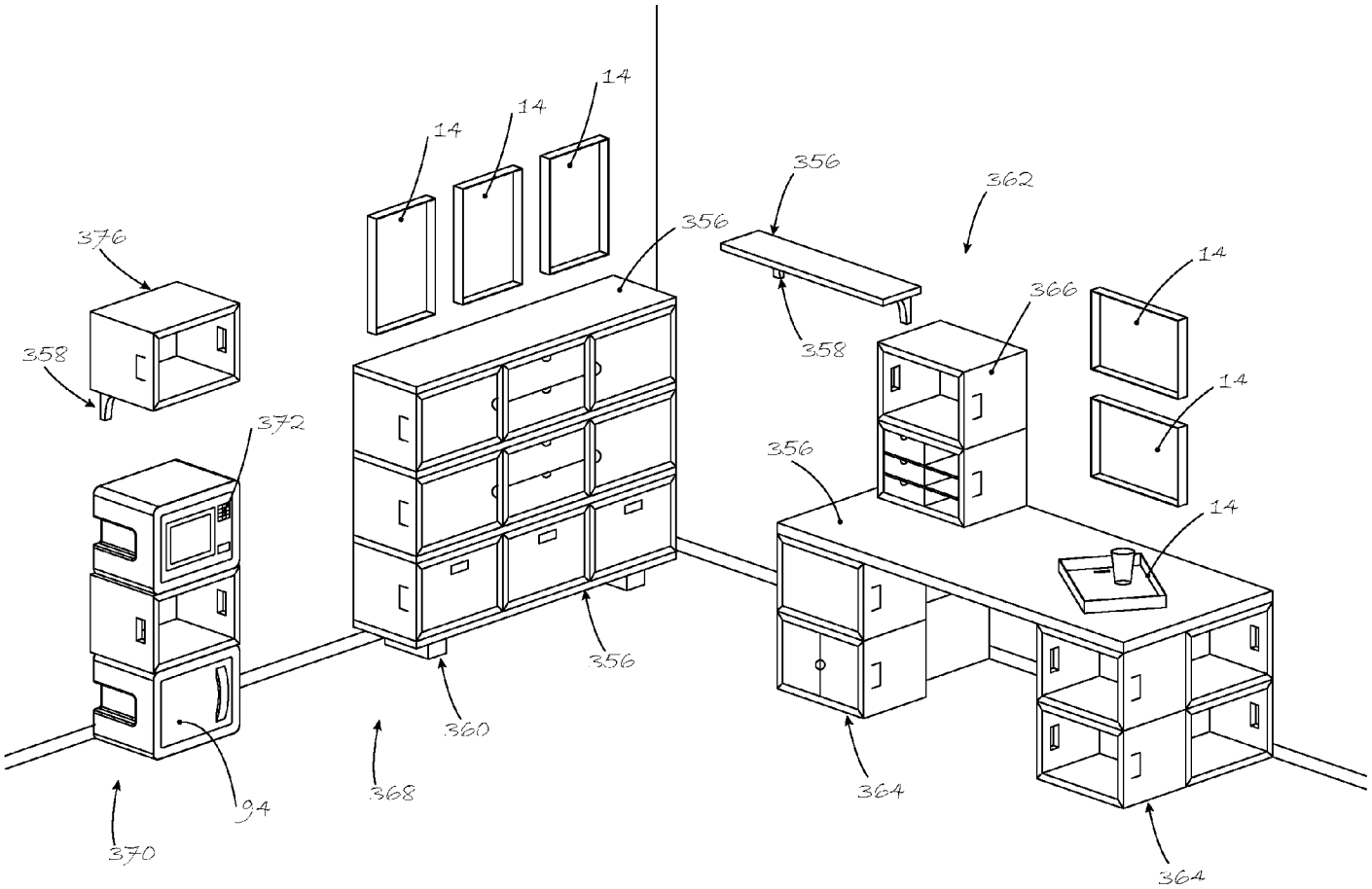
FIG. 15 is a view of exemplary base units configured as modular furniture.

FIG. 15 depicts various exemplary embodiments of furniture configurations that can be achieved with bases 12, internal members 122, and other components. For example, planar surfaces 356, brackets 358, and support feet 360 may complement the hybrid unit 10 to make furniture configurations.

A desk configuration 362 is provided by stacking bases 12 into two desk supports 364, for example each support 364 having four bases 12 units. A planar surface 356, such as a piece of wood or wood composite material, may span across the desk supports 364 and provide a surface area for working or eating. Additional stacked bases 12 on top of the planar surface 356 provide a hutch 366 for books or other items. An inverted lid 14 in the tray orientation may rest on the desk surface 356, carrying food and drinks.

Planar surfaces 356 also may be sandwiched between rows of bases 12 to form a storage unit configuration 368. The storage unit configuration 368 may have support feet 360 that serve to lift the entire configuration off the ground, for example to keep the bases 12 dry. Planar elements may also be supported by brackets 358 and hung on the wall to form shelves, as shown to the right of the storage configuration 368.

An exemplary kitchenette configuration 370 comprises three horizontally oriented base units 12. The top base unit 12 may house a microwave component 372. The bottom base unit 12 may house a refrigerator component 374. The middle base unit may be provided for storage of nonperishable food and drinks.

In various exemplary embodiments, lids 14 may be mounted to the wall, displaying artwork or used as cork boards. A base unit 12 may also be hung on a wall by brackets 358 to form wall shelving 376.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. For example, any of the aspects of the various embodiments described may be combined. This description is not necessarily intended to be exhaustive or to limit the invention to the precise embodiments disclosed. Additional embodiments are possible and are intended to be encompassed within this specification and the scope of the appended claims. The specification describes specific examples to accomplish a more general goal that may be accomplished in another way.

Only those claims which use the words "means for" are to be interpreted under 35 U.S.C. 112, sixth paragraph.

What is claimed is:

1. A hybrid modular furniture and container unit comprising:

a base shell comprising a shell bottom, a pair of shell side walls, a pair of shell end walls, and upper flaps associated with each respective shell wall;

a core layer comprising a core bottom, a pair of core side walls, and a pair of core end walls, the core layer disposed within the base shell;

an inner layer comprising a pair of inner layer side walls and a pair of inner layer end walls, the inner layer walls disposed within the core layer and the base shell; and each upper flap is folded over a respective core wall and inner layer wall so as to envelop the respective core wall and inner layer wall;

the core layer being a single piece of cross-shaped material such that each of the core side walls and each of the core end walls are foldably connected to the core bottom and independent from each other;

the core layer being separate from the base shell and the inner layer;

the walls of the core layer forming butt joints at each corner thereof;

whereby each of one of the core side walls and core end walls extends beyond one of one of the inner layer side walls and inner layer end walls and along an outer edge of each of the other one of the core side walls and core end walls so that an outer edge of each of one of the core side walls and core end walls is adjacent to one of the shell end walls of the base shell;

whereby the outer edge of each of one of the core side walls and core end walls engages an inner major planar surface of one of the other one of the core side walls and core end walls.

2. The hybrid modular furniture and container unit of claim 1, wherein the upper flaps folded over the respective core walls and inner layer walls define a pair of unit side walls, a pair of unit end walls, and an internal cavity.

3. The hybrid modular furniture and container unit of claim 1, wherein two of the four shell walls, two of the four core layer walls, and two of the four inner layer walls comprise a handle opening.

4. The hybrid modular furniture and container unit of claim 3, further comprising a handle flap foldably connected to the shell over the handle opening therein.

5. The hybrid modular furniture and container unit of claim 1, further comprising a first opening formed in one of the inner layer walls and a second opening formed in an opposite inner layer wall, the first and second openings for receiving a support.

6. The hybrid modular furniture and container unit of claim 5, wherein the support is a peg.

7. The hybrid modular furniture and container unit of claim 5, further comprising an internal member disposed on the support.

8. The hybrid modular furniture and container unit of claim 7, wherein the internal member is one of a shelf, a bin, a tray and a drawer.

9. The hybrid modular furniture and container unit of claim 1, wherein the base shell further comprises holes and cross-hatched slits formed in the base shell over the holes.

10. The hybrid modular furniture and container unit of claim 1, wherein the shell comprises a transition portion connecting each shell wall with its respective upper flap.

11. The hybrid modular furniture and container unit of claim 1, wherein the upper flaps are narrower than their respective shell walls.

12. The hybrid modular furniture and container unit of claim 1, further comprising a lid.

13. The hybrid modular furniture and container unit of claim 12, wherein the lid comprises:

a lid shell comprising a lid bottom, a first lid shell wall, a second lid shell wall, a third lid shell wall, a fourth lid shell wall, and lid upper flaps extending from each respective lid shell wall;

a lid core layer comprising a first lid core wall, a second lid core wall, a third lid core wall, and a fourth lid core wall, the lid core layer disposed within the lid shell; and a lid panel disposed within the lid shell and surrounded by the lid core walls, wherein each lid upper flap is folded over a respective lid core wall.

14. The hybrid modular furniture and container unit of claim 13, wherein the lid upper flaps are sandwiched between a respective lid shell wall and the lid panel.

15. The hybrid modular furniture and container unit of claim 1, wherein each of the upper flaps comprises a primary fold such that the upper flaps are hingedly connected to the shell walls at the primary fold; and wherein each of the upper flaps further comprises a secondary fold extending parallel to the primary fold and spaced therefrom.

16. The hybrid modular furniture and container unit of claim 1, further comprising a bottom panel disposed within the core layer and the base shell adjacent the core bottom; wherein the bottom panel is separate from the base shell, the core layer and the inner layer; and wherein an outer edge of the bottom panel faces an inner major planar surface of each of the inner layer walls of the inner layer.

17. The hybrid modular furniture and container unit of claim 16, wherein the upper flaps of the base shell are sandwiched between the bottom panel and the inner layer walls of the inner layer.

18. The hybrid modular furniture and container unit of claim 1, wherein the inner layer being a single strip of material such that each of the inner layer side walls is foldably connected to at least one of the inner layer end walls so as to form three corner folds and one corner joint.

19. The hybrid modular furniture and container unit of claim 18, wherein the corner joint is a butt joint or an interlocking joint.

* * * * *